US008550506B2

(12) United States Patent
Nakanishi et al.

(10) Patent No.: US 8,550,506 B2
(45) Date of Patent: Oct. 8, 2013

(54) MULTI-POINT MORTISE LOCK MECHANISM FOR SWINGING DOOR

(75) Inventors: Yoshikazu Nakanishi, Tokyo (JP); Manabu Shimoji, Tokyo (JP); Douglas A. Nolte, Owatonna, MN (US); Craig M. Doring, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 293 days.

(21) Appl. No.: 12/827,833

(22) Filed: Jun. 30, 2010

(65) Prior Publication Data

US 2010/0327610 A1 Dec. 30, 2010

Related U.S. Application Data

(60) Provisional application No. 61/221,975, filed on Jun. 30, 2009, provisional application No. 61/245,560, filed on Sep. 24, 2009, provisional application No. 61/248,673, filed on Oct. 5, 2009.

(51) Int. Cl.
*E05C 9/00* (2006.01)
*E05C 1/04* (2006.01)

(52) U.S. Cl.
USPC ..... 292/32; 292/162; 292/244; 292/DIG. 21

(58) Field of Classification Search
USPC ..... 292/32, 33, 39, 42, 162, 244, DIG. 21
See application file for complete search history.

(56) References Cited

U.S. PATENT DOCUMENTS 504,292 A 8/1893 Badoni
536,957 A 4/1895 Klein
540,911 A 6/1895 George
614,144 A 11/1898 Thompson
912,378 A 2/1909 Jackson
932,330 A 8/1909 Rotchford
958,880 A 5/1910 Lawson (Continued)

FOREIGN PATENT DOCUMENTS

DE 1095709 B 12/1960
DE 2914377 A1 10/1980

(Continued)

OTHER PUBLICATIONS

Office Action Cited in Canadian App. No. 2,708,912, Dated Nov. 8, 2011, 2 Pgs.

(Continued)

*Primary Examiner* — Carlos Lugo

(74) *Attorney, Agent, or Firm* — Patterson Thuente Pedersen, P.A.

(57) ABSTRACT

A multipoint mortise lock mechanism for a swinging door, including a central cassette assembly operably coupled to an upper remote locking point assembly and a lower remote locking point assembly by a remote locking linkage. The central cassette assembly includes a housing, a deadbolt mechanism, a latchbolt mechanism, a remote locking point mechanism and an anti-slam mechanism. The anti-slam mechanism includes an anti-slam plunger that when in an extended position engages the remote locking linkage via a boss and a slot and thereby inhibits movement of the remote locking linkage whereby deployment of the remote locking point assemblies is prevented. The deadbolt mechanism includes a deadbolt extendible from the central cassette that is independently operable from the remote locking point mechanism. The deadbolt mechanism further includes an anti-back drive mechanism.

14 Claims, 35 Drawing Sheets

(56) References Cited

U.S. PATENT DOCUMENTS 1,023,766 A 4/1912 Sinclair
1,051,918 A 2/1913 Rowley
1,065,172 A 6/1913 Riggs
1,070,366 A 8/1913 Voight
1,078,549 A 11/1913 Northey
1,174,652 A 3/1916 Banks
1,216,765 A 2/1917 Anderson
1,320,444 A 11/1919 Bucznyski
1,334,314 A 1/1920 Parsons
1,346,670 A 7/1920 Page
1,385,102 A 7/1921 Winters et al.
1,402,964 A 1/1922 Robertson
1,515,611 A 11/1924 O'Connor
1,533,243 A 4/1925 Galterio
1,559,160 A 10/1925 Carter
1,585,689 A 5/1926 Piggot
1,646,674 A 5/1926 Angelillo
1,663,572 A 3/1928 Stuart et al.
1,672,076 A 6/1928 Munson
2,033,079 A * 3/1936 Lohrs ..... 292/2
2,066,705 A 1/1937 Vazquez
2,159,315 A * 5/1939 Blue ..... 292/2
2,166,535 A 7/1939 Särenholm et al.
2,406,459 A 8/1946 Gibson
2,498,508 A 2/1950 Rudolph
2,701,157 A 2/1955 Le Bon, III
2,712,464 A 7/1955 Collar et al.
2,736,185 A 2/1956 Collar
2,823,941 A * 2/1958 Ellis ..... 292/137
2,855,234 A 10/1958 Eads
2,924,475 A 2/1960 Russell
2,943,514 A 7/1960 Golde
2,980,458 A 4/1961 Russell
3,041,097 A 6/1962 Eads
3,088,471 A 5/1963 Fiore
3,107,113 A 10/1963 Sconzo
3,195,171 A 7/1965 Klein
3,342,516 A 9/1967 Morand
3,400,562 A 9/1968 Bloss
3,543,441 A 12/1970 La Porte
3,586,360 A 6/1971 Perrotta
3,596,954 A 8/1971 Hull et al.
3,638,461 A 2/1972 Watson
3,666,306 A * 5/1972 Genakis ..... 292/169.17
3,949,525 A 4/1976 Bates et al.
3,953,061 A 4/1976 Hansen et al.
4,050,272 A 9/1977 Tanaka
4,068,874 A 1/1978 Fleming et al.
4,118,056 A 10/1978 Alexander
4,148,106 A 4/1979 Gallien
4,199,060 A 4/1980 Howard
4,253,688 A 3/1981 Hosooka
4,335,816 A 6/1982 Rager
4,389,061 A 6/1983 Foshee
4,434,635 A 3/1984 Borgato
4,476,700 A 10/1984 King
4,480,862 A 11/1984 Fleming
4,547,006 A 10/1985 Castanier
4,602,457 A 7/1986 Kreusel
4,639,021 A 1/1987 Hope
4,643,005 A 2/1987 Logas
4,676,537 A 6/1987 Esser
4,739,583 A 4/1988 Tönsmann et al.
4,803,808 A 2/1989 Greisner
4,870,841 A 10/1989 Cudd
4,932,691 A 6/1990 White
4,958,508 A 9/1990 Lin
4,962,653 A 10/1990 Kaup
4,973,091 A 11/1990 Paulson et al.
4,980,946 A 1/1991 Verasani et al.
4,988,133 A * 1/1991 Shih ..... 292/191
4,991,886 A 2/1991 Nolte et al.
5,045,265 A 9/1991 Pettit
5,058,938 A 10/1991 Döring et al.
5,078,200 A 1/1992 Guntermann et al.
5,087,087 A 2/1992 Vetter et al.
5,118,145 A 6/1992 Tucker
5,120,094 A 6/1992 Eaton et al.
5,183,310 A 2/1993 Shaughnessy
5,197,771 A 3/1993 Kaup et al.
5,245,846 A 9/1993 James
5,253,903 A 10/1993 Daley
5,290,077 A 3/1994 Fleming
5,301,525 A 4/1994 Döring
5,370,428 A 12/1994 Dreifert et al.
5,373,716 A 12/1994 MacNeil et al.
5,388,875 A 2/1995 Fleming
5,495,731 A 3/1996 Riznik
5,498,038 A 3/1996 Simon et al.
5,524,941 A 6/1996 Fleming
5,524,942 A 6/1996 Fleming
5,531,492 A 7/1996 Raskevicius
5,542,720 A 8/1996 Fleming
5,603,538 A 2/1997 Evers
5,620,261 A 4/1997 Fuller
5,642,909 A 7/1997 Swan et al.
5,660,420 A 8/1997 Smith et al.
5,722,704 A 3/1998 Chaput et al.
5,741,031 A 4/1998 Bauman et al.
5,752,727 A 5/1998 Zeus et al.
5,778,602 A 7/1998 Johnson et al.
5,782,114 A 7/1998 Zeus et al.
5,791,790 A 8/1998 Bender et al.
5,813,255 A * 9/1998 Tell et al. ..... 70/107
5,820,170 A 10/1998 Clancy
5,820,177 A * 10/1998 Moon ..... 292/335
5,839,767 A 11/1998 Piltingsrud
5,878,605 A 3/1999 Renz
5,878,606 A 3/1999 Chaput et al.
5,890,753 A 4/1999 Fuller
5,896,763 A * 4/1999 Dinkelborg et al. ..... 70/93
5,901,989 A 5/1999 Becken et al.
5,906,403 A 5/1999 Bestler et al.
5,927,767 A 7/1999 Smith et al.
5,951,068 A 9/1999 Strong et al.
6,006,560 A 12/1999 DeVries
6,045,169 A * 4/2000 Frolov ..... 292/332
6,135,511 A 10/2000 Smith et al.
6,161,881 A 12/2000 Babka et al.
6,209,931 B1 4/2001 Von Stoutenborough et al.
6,217,087 B1 4/2001 Fuller
6,266,981 B1 7/2001 Von Resch et al.
6,282,929 B1 9/2001 Eller et al.
6,289,704 B1 9/2001 Collet et al.
6,324,876 B1 12/2001 Prevot et al.
6,327,881 B1 * 12/2001 Grundler et al. ..... 70/107
6,349,982 B2 * 2/2002 Fayngersh et al. ..... 292/165
6,354,121 B1 * 3/2002 Frolov ..... 70/277
6,367,853 B1 4/2002 Briggs
6,389,855 B2 5/2002 Renz et al.
6,393,878 B1 * 5/2002 Fayngersh et al. ..... 70/107
6,557,909 B2 * 5/2003 Morris ..... 292/169.15
6,651,389 B2 11/2003 Minter et al.
6,651,466 B1 11/2003 Shih
6,682,109 B2 1/2004 Horne et al.
6,688,656 B1 2/2004 Becken
6,837,004 B2 1/2005 Annes
6,871,451 B2 3/2005 Harger et al.
6,871,884 B2 3/2005 Hoffmann et al.
6,962,377 B2 11/2005 Tönges
6,971,686 B2 12/2005 Becken
7,003,990 B2 2/2006 Iliuk
7,004,515 B2 2/2006 Timothy
7,025,394 B1 4/2006 Hunt
7,108,300 B2 * 9/2006 Hodgin et al. ..... 292/244
7,178,839 B2 2/2007 Tsai
7,303,215 B2 * 12/2007 Moon et al. ..... 292/32
7,418,845 B2 9/2008 Timothy
7,510,222 B2 * 3/2009 Hodgin et al. ..... 292/244
7,752,875 B2 * 7/2010 Constantinou et al. ..... 70/107
2004/0145189 A1 7/2004 Liu
2006/0071478 A1 4/2006 Denys
2006/0087125 A1 * 4/2006 Moon et al. ..... 292/32

| | | | |
|---|---|---|---|
| 2006/0091679 | A1 | 5/2006 | Tsai |
| 2007/0096476 | A1 | 5/2007 | Vetter |
| 2008/0265587 | A1 | 10/2008 | Nakanishi et al. |

FOREIGN PATENT DOCUMENTS

| | | | | |
|---|---|---|---|---|
| DE | 10255733 | A1 | | 6/2004 |
| EP | 117744 | A2 | * | 9/1984 |
| EP | 0278704 | B1 | | 10/1990 |
| EP | 0431369 | A2 | | 6/1991 |
| EP | 0327264 | B1 | | 12/1992 |
| EP | 0661409 | A2 | | 7/1995 |
| FR | 2435586 | | | 4/1980 |
| GB | 2101673 | A | | 1/1983 |
| GB | 2122244 | A | | 1/1984 |
| GB | 2167112 | A | | 5/1986 |
| GB | 2212849 | A | * | 8/1989 |
| GB | 2215770 | A | | 9/1989 |
| GB | 2225607 | A | | 6/1990 |
| GB | 2242702 | A | | 10/1991 |
| GB | 2281097 | A | | 2/1995 |
| GB | 2320279 | A | | 6/1998 |
| GB | 2337556 | A | | 11/1999 |
| JP | 06-010553 | | | 1/1994 |

OTHER PUBLICATIONS

U.S. Appl. No. 61/221,975, filed Jun. 30, 2009.
U.S. Appl. No. 61/245,560, filed Sep. 24, 2009.
U.S. Appl. No. 61/248,673, filed Oct. 5, 2009.
U.S. Appl. No. 12/573,532, filed Oct. 5, 2009, Publication No. 2010/0218568, Published Sep. 2, 2010.
U.S. Appl. No. 12/124823, filed May 21, 2008, Publication No. 2009/0019779, Published Jan. 22, 2009.
Rejuvenation, Large Brass Casement Window Fastener 8389, www.rejuvenation.com , Mar. 3, 2005, 1 Pg.
Ferco Corp., Fittings for tilt-turn gears JET AS 130 Aluminium joinery, 1991, 12 Pgs.
Truth Hardware, Multi-Point Locking System, Truth Hardware Catalog, 1993, 8 Pgs., pp. 2.7-2.7g.
Truth Hardware, Engineering Drawing No. 31868, Nov. 3, 1996, 1 Pg.
Truth Hardware, Mirage™ Concealed Multi-Point Locking System (Tie Bar in Jamb version), *Truth Hardware Catalog*, 1996, 12 pgs., pp. 2.5-2.5k.

* cited by examiner

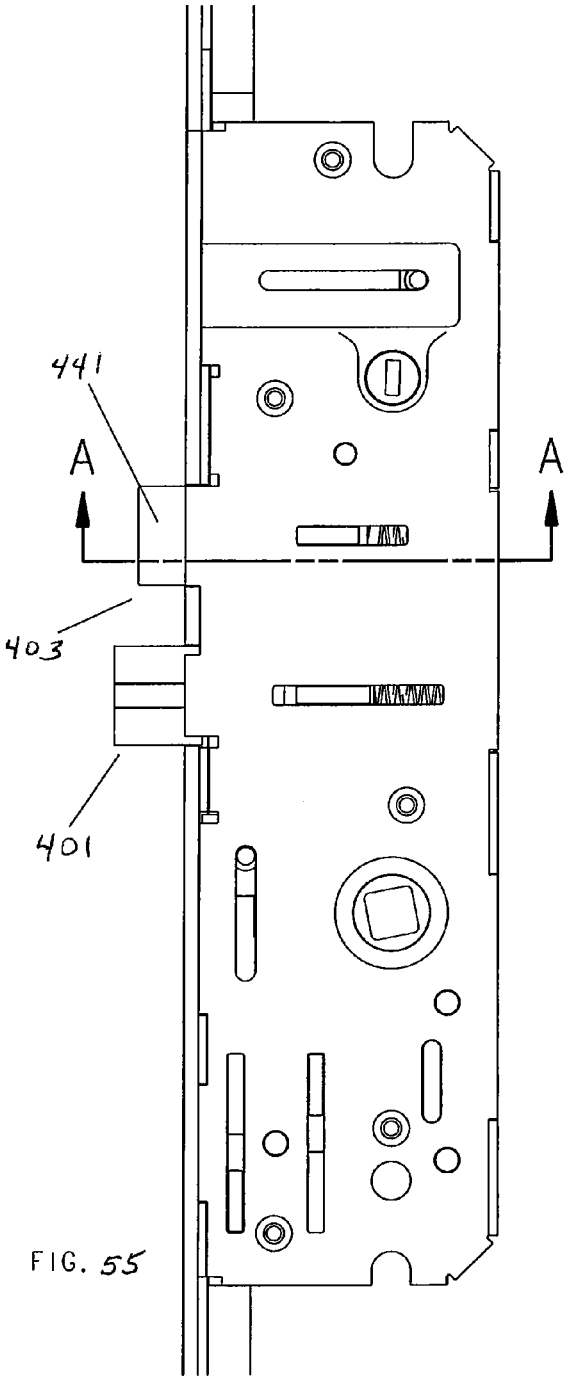
FIG. 55
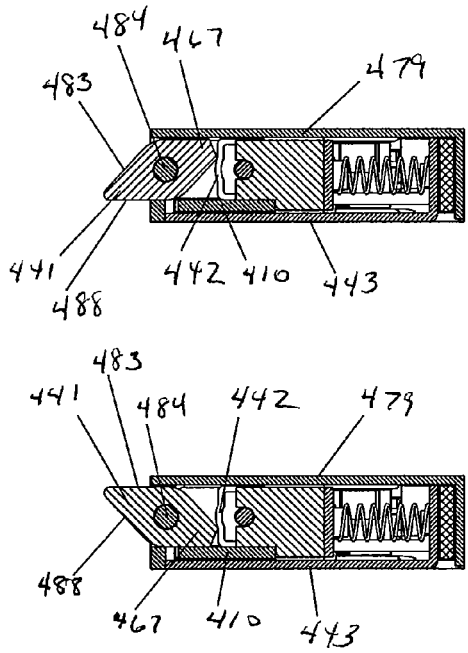
SECTIONS A-A

MULTI-POINT MORTISE LOCK MECHANISM FOR SWINGING DOOR

CLAIM TO PRIORITY

This application claims the benefit of U.S. Provisional Application 61/221,975 entitled "Multi-point Mortise Lock Mechanism for Swinging Door" filed Jun. 30, 2009, U.S. Provisional Application 61/248,673 entitled "Door Latch with Integrated Latch Lubrication Strip" filed Oct. 5, 2009 and U.S. Provisional Application 61/245,560 entitled "Multi-point Mortise Lock Mechanism for Swinging Door" filed Sep. 24, 2009, the entire contents of all of the above applications are incorporated herein by reference.

FIELD OF THE INVENTION

The present invention relates to lock mechanisms for doors, and more specifically, to multi-point lock mechanisms for swinging doors.

BACKGROUND OF THE INVENTION

While multi-point lock mechanisms for swinging doors are known, devices developed to date have drawbacks and have not entirely fulfilled the needs of the industry.

In the field of swinging door latching devices it is common to have a wedge shaped latchbolt that extends from a cassette or cylindrical cartridge containing an actuating mechanism. The latchbolt is generally spring-loaded and biased toward the extended position, and is retracted against the bias of the spring by operation of a lever or knob. The latchbolt typically contacts a strike plate in a door frame in such a way as to press the spring loaded latchbolt into the cassette until the latchbolt reaches a hole in the strikeplate. The spring loaded latchbolt then engages in the strikeplate hole and secures the door panel to the door frame.

Prior latchbolts are generally made of metal and have a tendency to scratch and mar the corresponding strikeplates, many of which are decorative plated, causing noisy and rough operation when closing the door panel in the door frame, and an unsightly appearance to the strikeplate. Accordingly, what is needed in the industry is a latch mechanism with a latch bolt that does not cause scratching and marring of the strikeplate.

SUMMARY OF THE INVENTION

Embodiments of the invention address the needs of the industry by providing all or certain of these features in a multi-point lock assembly for a swinging door:

In one embodiment the invention includes an Anti-slam mechanism including a detent and rotatable paddle. The detent and rotatable paddle make the anti-slam mechanism bidirectional.

In another embodiment of the invention, the Anti-slam mechanism includes an independent tie in to the remote bolts via a boss and a slot. This permits the remote bolts to be operated independent of whether the deadbolt is locked or not.

In another embodiment of the invention, the Anti-slam mechanism includes an independent tie in to dead bolt via linkage. This permits the deadbolt to be operated whether the remote bolts are locked or not.

Another aspect of the invention permits the Dead bolt and remote bolts to operate independently in extension and retraction.

The invention may include a Dead bolt driver that extends the dead bolt and locks out the handle of the lock mechanism with a stop bar.

In another aspect of the invention, both a spring loaded pawl and a dead bolt driver secure the deadbolt in the locked position so that there are two support points to prevent back drive of dead bolt.

The invention further includes a method of lifting spring loaded pawl to bypass support point when retracting dead bolt.

In another embodiment the invention includes a flat spring that provides for detent feel of dead bolt driver and retention of dead bolt in position.

In another embodiment the invention includes a torsion spring for the upper operation bar to hold it in position.

In another aspect of the invention a compression spring is used to return the handle to a neutral position and to control handle droop so that the handle returns reliably to the neutral position.

In another embodiment the invention includes a reversibly handed anti-slam plunger that changes handedness via a rotating paddle.

In another aspect of the invention, the invention includes a rotating latch bolt for interchangeable handing and retaining of the latch bolt at the functional position.

The invention may further include reversed upper and lower drive bars so that gravity assists in balancing the upper and lower tie bars and remote bolts.

In another embodiment, the present invention addresses the need of the industry for a latch mechanism with a latchbolt that does not cause scratching and marring of the strikeplate. According to embodiments of the invention, a lubrication strip made of a lubricious, yet durable material is inset into the latchbolt. The lubrication strip is disposed so as to contact and slide along the strikeplate when the door is closed, thereby preventing contact between the metal portions of the latchbolt with the strikeplate, and as a result, inhibiting scratching and marring of the strikeplate.

BRIEF DESCRIPTION OF THE DRAWINGS

The invention may be more completely understood in consideration of the following detailed description of various embodiments of the invention in connection with the following drawings, in which:

FIG. 55 is a sectional view of the lock cassette of FIG. 37 taken through section A-A with the anti-slam plunger configured in two different positions according to an embodiment of the invention;

Figure 1:
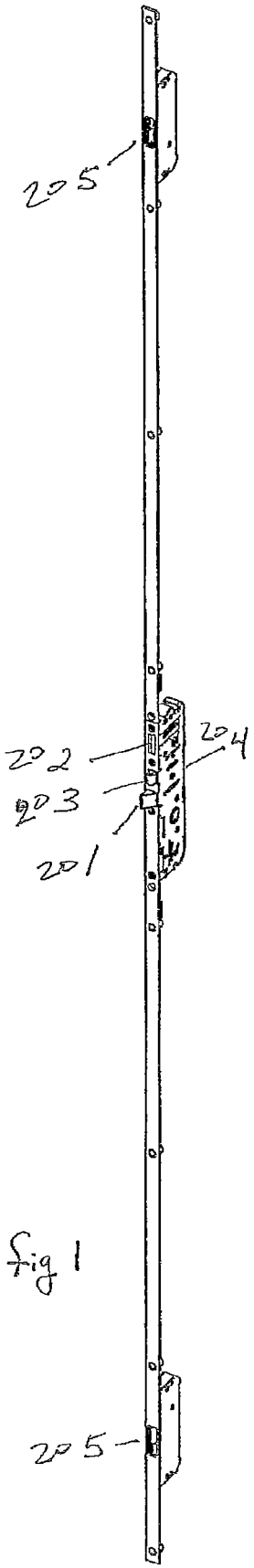
FIG. 1 is a perspective view of a multi-point lock assembly according to an embodiment of the invention.

While the present invention is amendable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION

Figure 2:
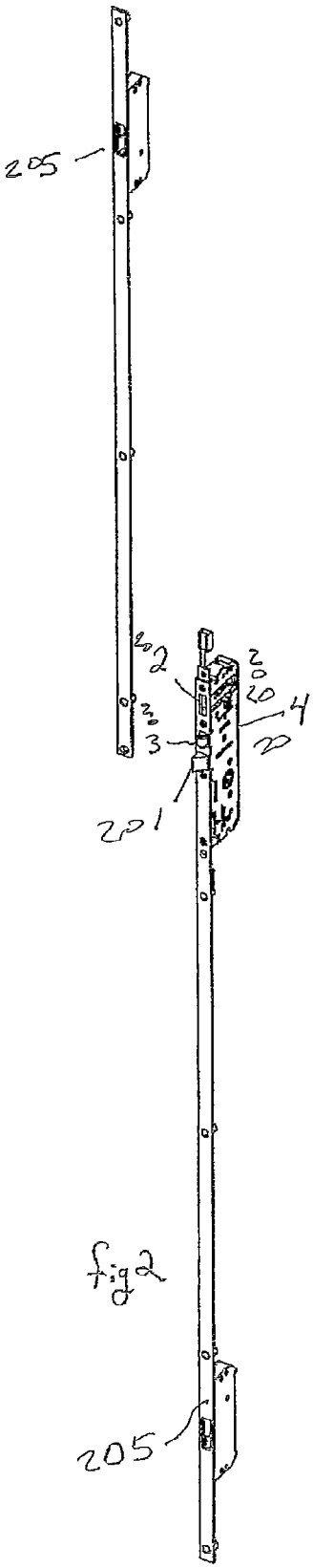
FIG. 2 is another perspective view of a multi-point lock assembly of FIG. 1.
Figure 1A:
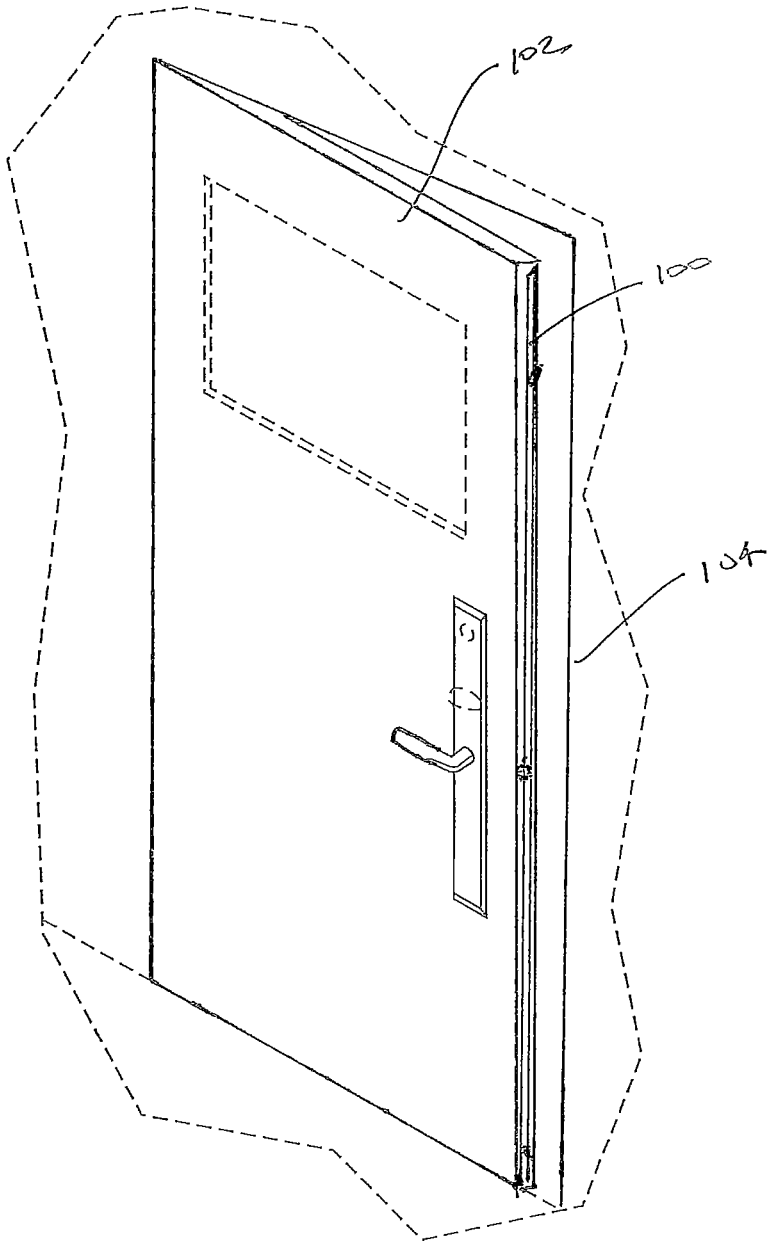
FIG. 1A is a perspective view of a swinging door with the multi-point lock assembly of FIG. 1 therein.

Lock assembly 100 according to an embodiment of the invention is depicted in FIGS. 1-16. In FIG. 1A, lock assembly 100 is depicted as mounted in the edge of a swinging door 102. As depicted in FIG. 1, lock assembly 100 generally includes latch bolt 201, dead bolt 202, and anti-slam plunger 203 located in central cassette 204 with two or more remote locking points 205. Remote locking points 205 can be permanently attached to the center cassette or attachable as a separate module as depicted in FIG. 2.

Locks at the remote locking points 205 may be tungs, hooks, bolts, etc. that extend horizontally into a vertical door frame and/or may be shoot bolts that extend vertically into a horizontal door frame header and threshold.

Figure 3:
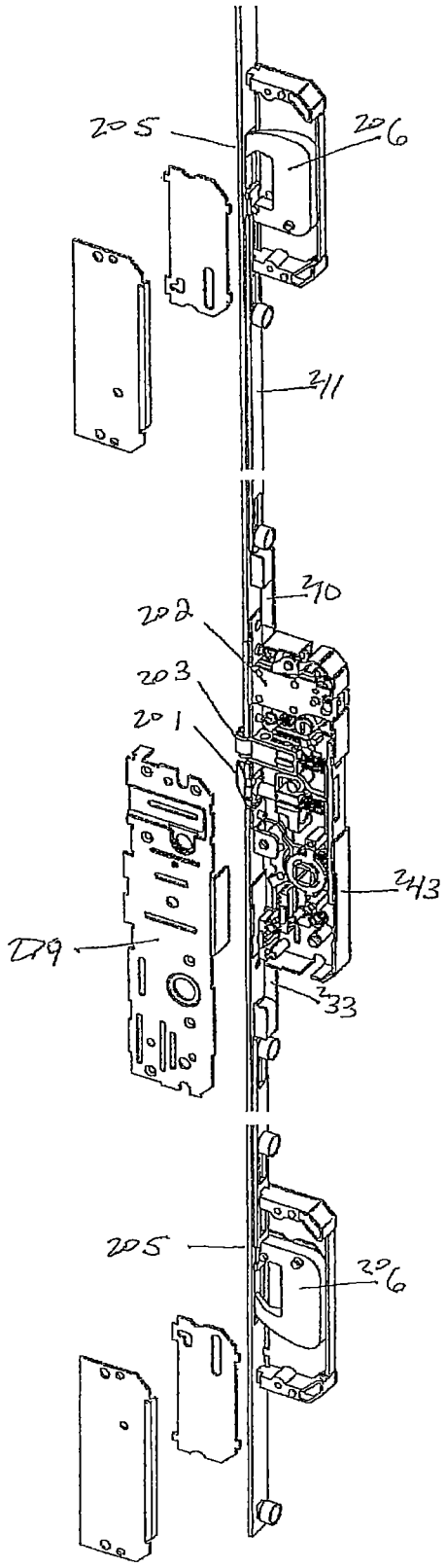
FIG. 3 is a partially exploded view of the lock assembly of FIG. 1.

As depicted in FIG. 3, remote locking points 205 may also generally include hook 206 as is commonly known in the art. Further general details of multi-point locking systems are disclosed in PCT International Publication No. WO 2008/153707 hereby fully incorporated herein by reference.

Figure 4:
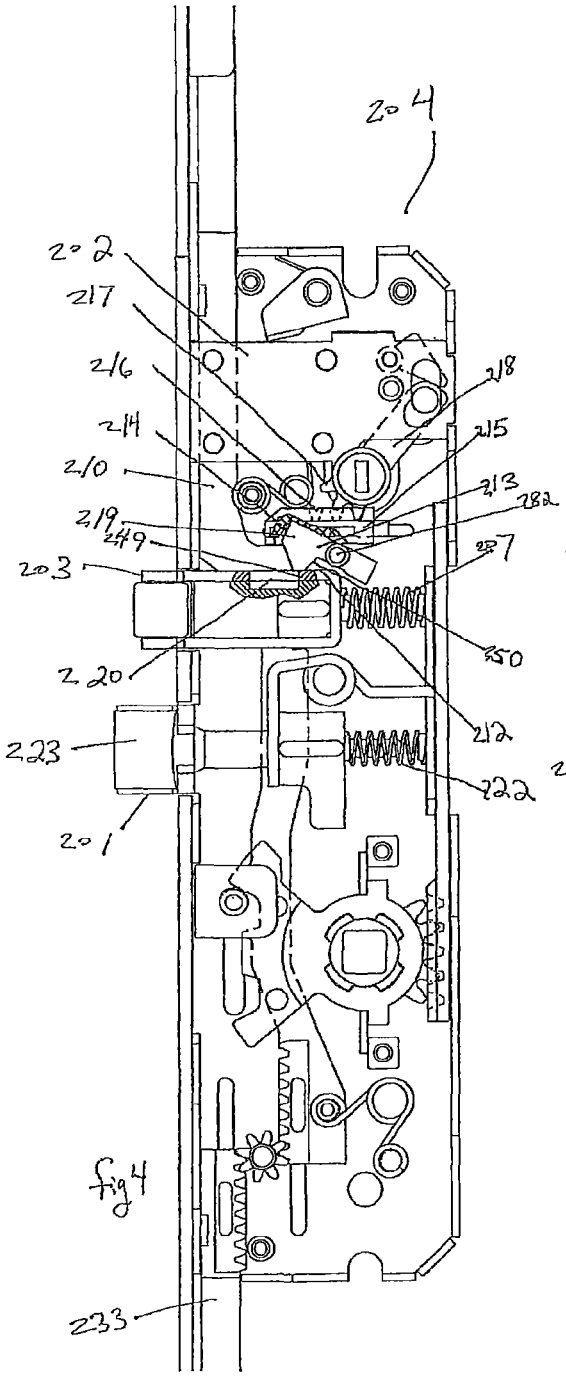
FIG. 4 is a side elevation view of the central cassette of the lock assembly of FIG. 1 with the anti-slam plunger extended.

As depicted in FIGS. 1A and 4, when swinging door 102 is in the open position, swung away from door frame 104, anti-slam plunger 203 protrudes from central cassette 204. Anti-slam plunger 203 is biased toward the extended position by compression spring 207. Boss 208 of anti-slam plunger 203, depicted in FIG. 6, engages with slot 209 in upper operation bar 210, thereby blocking translational movement of operation bar 210.

As depicted in FIG. 3, remote locking points 205 are coupled to operation bars 210 and 233 with tie bars 211 and the remote locking points 205 are thereby prevented from being extended when anti-slam plunger 203 is extended.

As depicted in FIG. 4, pawl 213 is rotatable about boss 282. Side 212 of anti-slam plunger 203 engages end 219 of pawl 213 in a rotated position, engaging with slot 214 in stop bolt 215, blocking the stop bolt 215 from translational movement. Stop bolt 215 defines rack 216 that engages gear teeth 217 defined in dead bolt driver 218, thus blocking dead bolt 202 from being extended.

Figure 5:
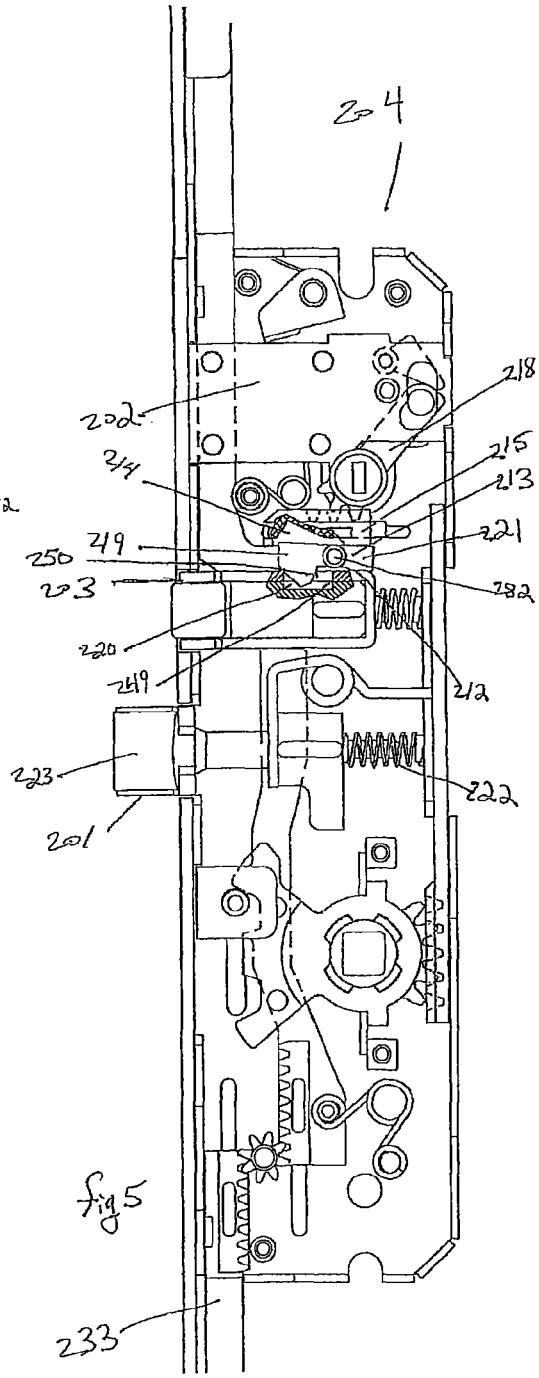
FIG. 5 is a side elevation view of the central cassette of the lock assembly of FIG. 1 with the anti-slam plunger depressed.
Figure 6:
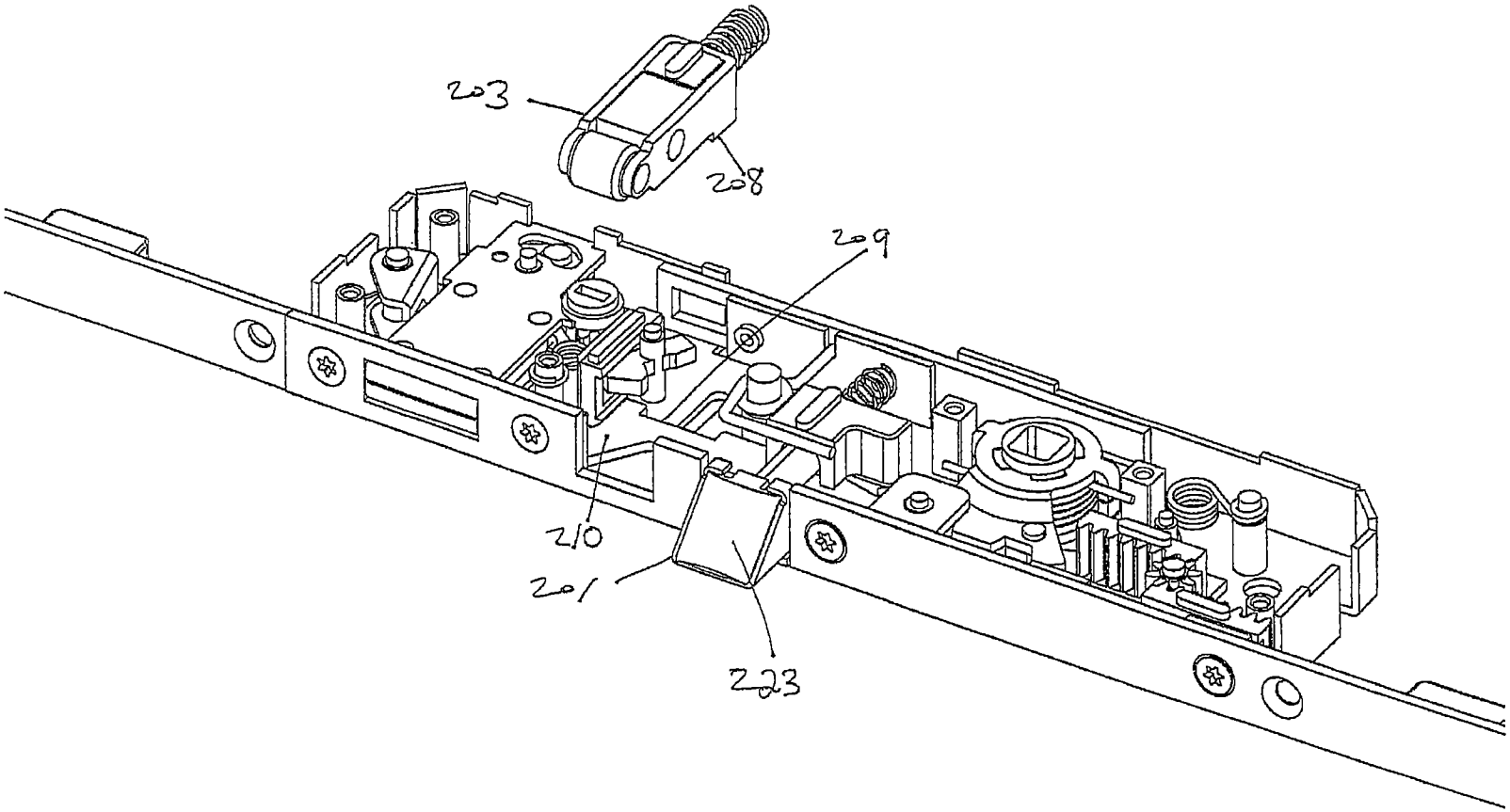
FIG. 6 is a partially exploded perspective view of the central cassette of the lock assembly of FIG. 1.

As depicted in FIG. 5, when door 102 is closed, anti-slam plunger 203 contacts a strike in door frame 104, depressing anti-slam plunger 203. Boss 208 of anti-slam plunger 203 clears slot 209 in upper operation bar 210 enabling translational movement of upper operation bar 210 and extension of remote locking points 205. Clearance slot 220 in side 212 of anti-slam plunger 203 registers with end 219 of pawl 213 at the same time that anti-slam plunger 203 contacts opposite end 221 of pawl 213 and end 219 rotates out of slot 214 in stop bolt 215 and into clearance slot 220 of anti-slam plunger 203. Stop bolt 215 is thereby freed for translational movement, enabling rotational movement of dead bolt driver 218 to extend dead bolt 202.

The effect is that when door 102 is open, remote locking points 205 and dead bolt 202 are blocked from extending, thus preventing remote locking points 205 and dead bolt 202 from "slamming" and damaging the door frame as the door is closed. Remote locking points 205 and dead bolt 202 are free to extend when the door is closed. Compression spring 222 loaded latch bolt 201 has an angled ramp surface 223 that causes it to depress as it contacts a strike in door frame 104, and extends once it reaches a slot in the strike (not shown) latching the door, similar to latch bolts common in the field.

Figure 7:
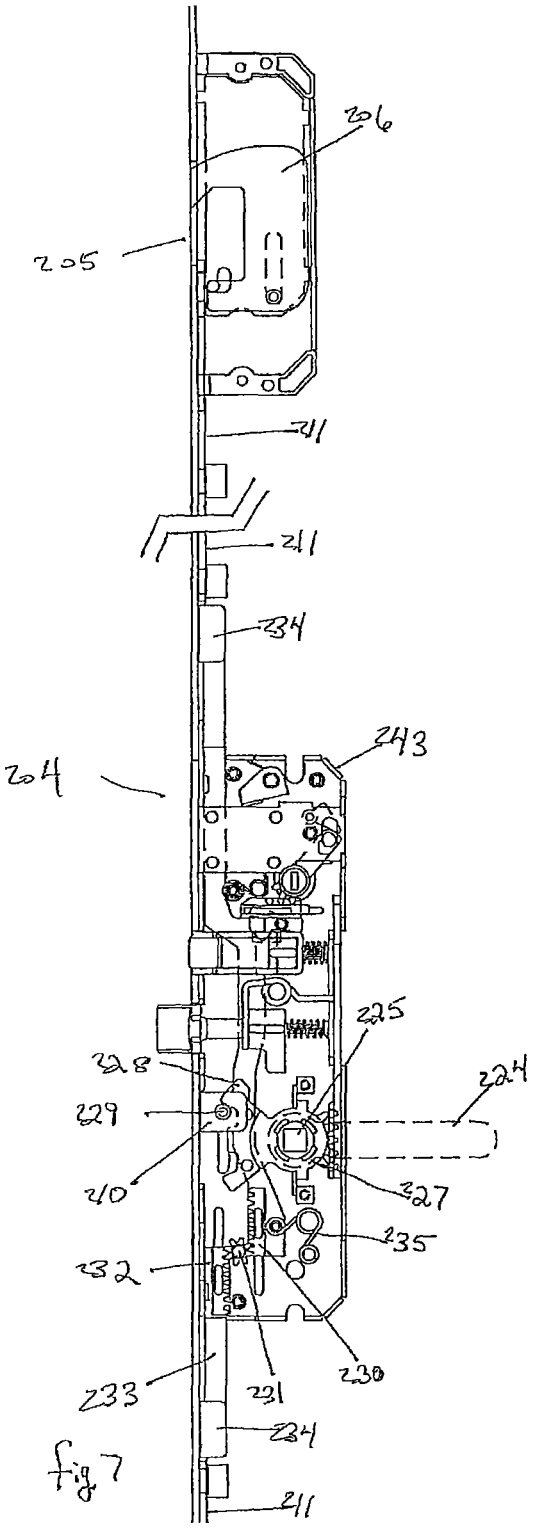
FIG. 7 is a fragmentary side elevation view of the lock assembly of FIG. 1 in a first operational disposition.
Figure 8:
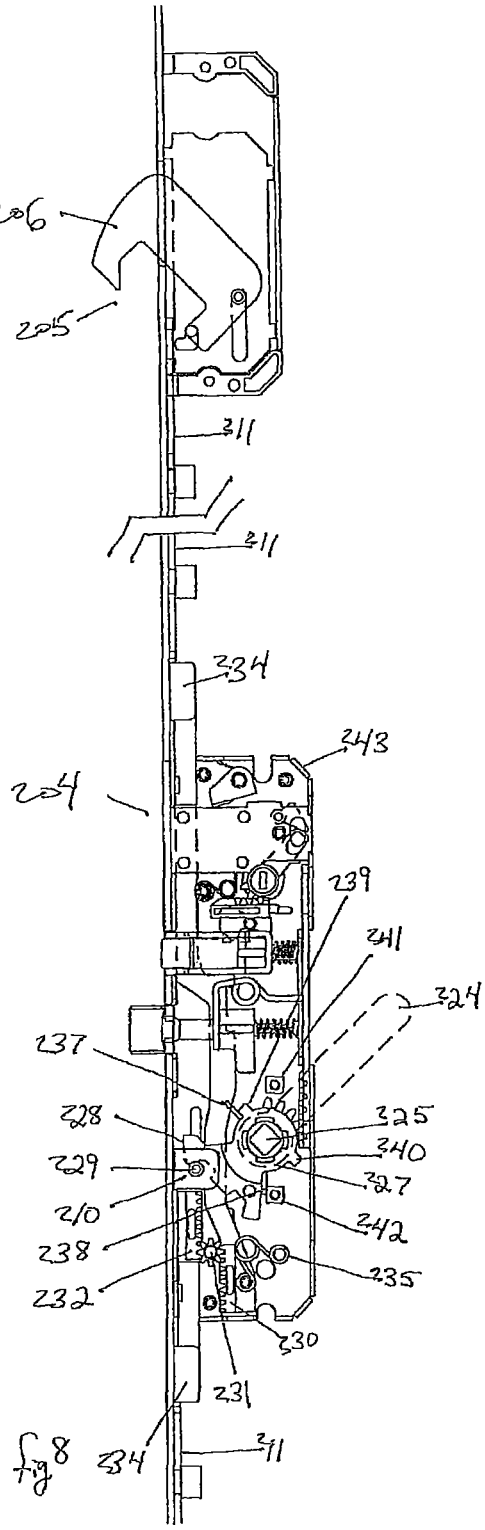
FIG. 8 is a fragmentary side elevation view of the lock assembly of FIG. 1 in a second operational disposition.

As depicted in FIGS. 7 and 8, remote locking points 205 are extended by a rotational input from door handle 224 that is keyed to central spindle 225. Spindle 225 protrudes and is keyed to crank 227 in central cassette 204. Crank 227 has upper arm 228 that rotates downward contacting captured pin 229 in upper operation bar 210 and urging upper operation bar 210 in a downward direction. Upper operation bar 210 defines rack 230 at the lower end that drives pinion 231 rotationally, in turn driving rack 232 defined in lower operation bar 233 in an upward direction. Operation bars 210 and 233 are coupled to tie bars 211 by toothed racks 234. Tie bars 211 are coupled to and drive remote locking points 205 to the extended position into strikes located on the door vertical frame or, in the case of shoot bolts (not shown), drive the bolts vertically into strikes located on the door frame header or threshold. As door handle 224 is released, torsion spring 235 holds operation bars 210 and 233 in the extended position, while crank torsion spring 236 has leg 237 that pushes against crank tab 239 and leg 238 bearing against standoff 242 that drives the crank 227 to the neutral position. It is important to note that remote locking points 205 can be extended regardless of whether dead bolt 202 is extended or retracted.

Figure 9:
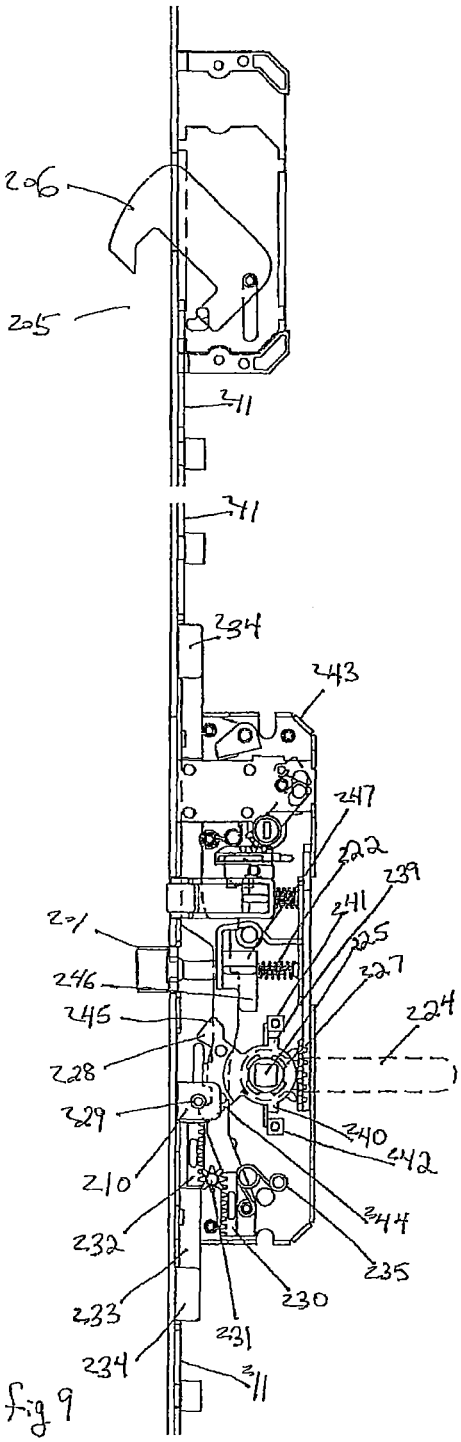
FIG. 9 is a fragmentary side elevation view of the lock assembly of FIG. 1 in a third operational disposition.
Figure 10:
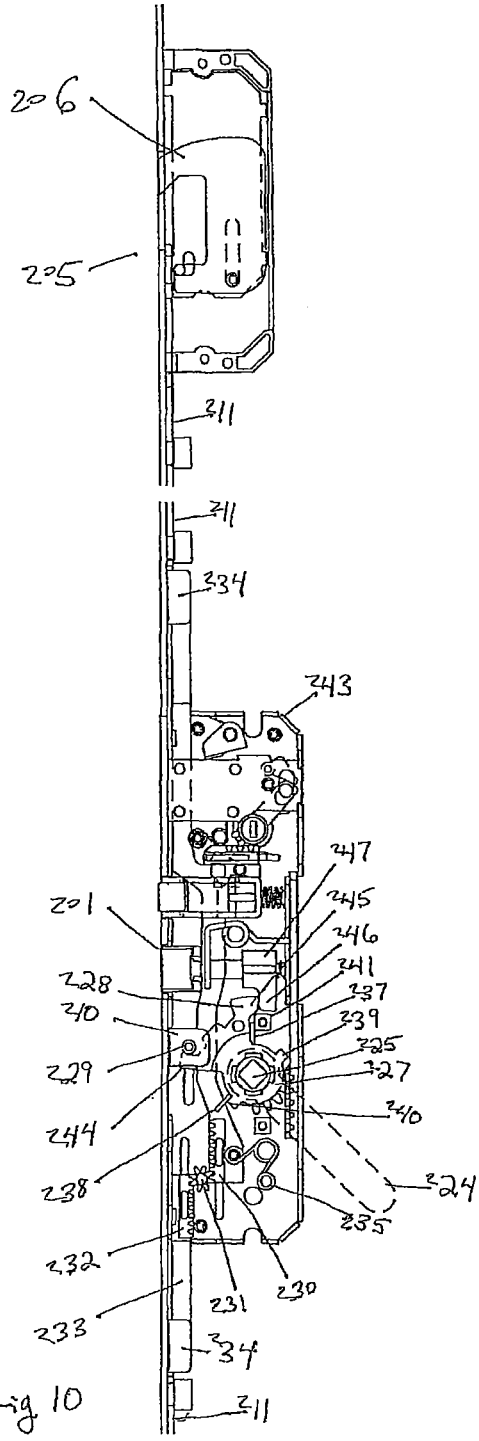
FIG. 10 is a fragmentary side elevation view of the lock assembly of FIG. 1 in a fourth operational disposition.
Figure 11:
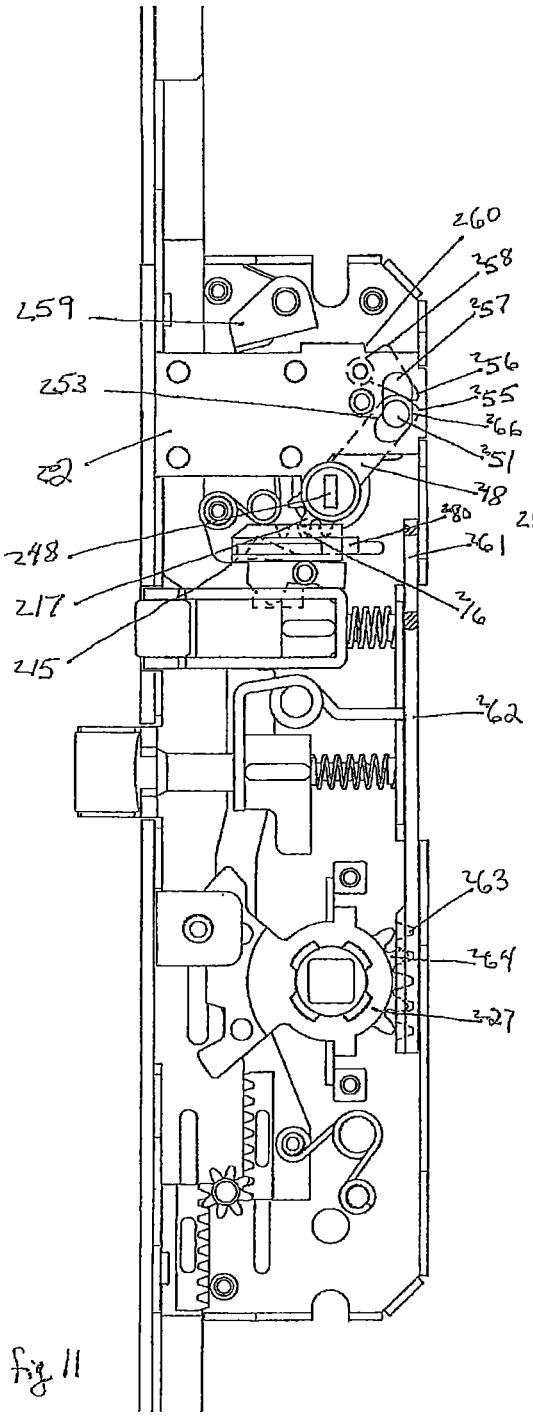
FIG. 11 is a side elevation view of the central cassette of the lock assembly of FIG. 1 with the dead bolt in a retracted position.
Figure 12:
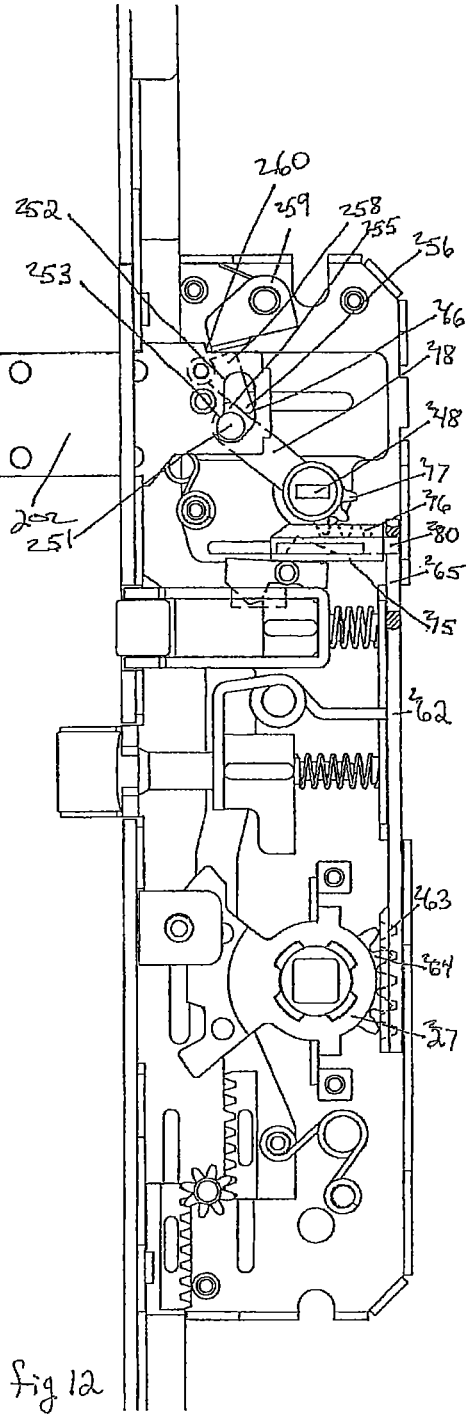
FIG. 12 is a side elevation view of the central cassette of the lock assembly of FIG. 1 with the dead bolt in an extended position.

As depicted in FIGS. 9 and 10, remote locking points 205 are retracted by a rotational input from door handle 224 keyed to central spindle 225 which protrudes and is keyed to crank 227 in central cassette 204. Crank 227 has lower arm 244 that rotates upward and contacts captured pin 229 in upper operation bar 210 and pushes upper operation bar 210 in an upward direction. Rack 230 of upper operation bar 210 drives pinion 231 rotationally, thereby driving rack 232 in lower operation bar 233 in a downward direction. Operation bars 210 and 233 drive tie bars 211 via toothed racks 234. Tie bars 211 drive remote locking points 205 and/or shoot bolts to the retracted position, disengaging remote locking points 205 from strikes in the door frame 104. Crank 227 defines lobe 245 on upper arm 228 that contacts a corresponding lobe 246 on latch bolt base 247, thereby retracting latch bolt 201 against the bias of compression spring 222. When retracted, latch bolt 201 is disengaged from the strikes in door frame 104. Alternatively, with remote locking points 205 in the retracted position, door handle 224 can be rotated downward and latch bolt 201 retracted.

As all bolts 201, 202, 205, are retracted, door 102 may now be rotated to the open position. As anti-slam plunger 203 moves away from door frame 104, it is released to the extended position. Boss 208 shifts into slot 209 on upper operation bar 210, blocking movement of upper operation bar 210 and effectively blocking extension of remote locking points 205. Simultaneously as depicted in FIG. 5, wall 249 inside slot 220 of anti-slam plunger 203 bears against ramped surface 250 on pawl 213, causing end 219 of pawl 213 to rotate out of slot 220 and into engagement in slot 214 on stop bolt 215, blocking stop bolt 215 from shifting, and thus blocking dead bolt driver 218 from driving dead bolt 202. As depicted in FIGS. 9 and 10, when door handle 224 is released, torsion spring 235 retains operation bars 210 and 233 in the retracted position. Crank torsion spring 236 presents leg 238 that pushes against crank tab 240 and leg 237, bearing against standoff 241 and driving crank 227 to the neutral position. Simultaneously, lobe 245 in upper arm 228 of crank 227 rotates away from latch bolt lobe 246, enabling the compression spring to extend latch bolt 201.

Bolt 202 is extended by a rotation of a thumb turn or thumb turn/lock cylinder common in the field (not shown). A spindle (common in the field) protrudes from the thumb turn into slot 248 in dead bolt driver 218. As dead bolt driver 218 rotates, boss 251 on opposite end 255 engages cam slot 252, driving dead bolt 202 in a horizontal translational motion. Cam slot 252 presents surface 253 such that, as dead bolt 202 reaches its maximum extension, boss 251 on dead bolt driver 218 reaches a toggle position in the cam slot 252, blocking dead bolt 202 from being back driven by a force applied to end surface 254 of dead bolt 202 parallel to dead bolt translational motion. Simultaneously, as dead bolt driver 218 rotates, opposite end 255 of dead bolt driver 218 urges lobe 256 on lifter 257 in a rotational motion such that upper lobe 258 contacts and lifts spring loaded pawl 259. As dead bolt 202 reaches full extension, lifter 257 is enabled to rotate down, dropping pawl 259 below notch 260 in dead bolt 202 to thereby assist in blocking dead bolt 202 from being back driven. Dead bolt driver 218 defines gear teeth 217 that engage rack 216 in stop bolt 215. As dead bolt driver 218 rotates, it drives stop bolt 215 in a horizontal direction, and engaging protrusion 280 in slot 261 in stop bar 262, thereby blocking downward translational movement of stop bar 262. Rack 263 in stop bar 262 engages gear teeth 264 in crank 227, blocking downward rotation of crank 227 and thus blocking retraction of remote locking points 205 if they are already extended. Slot 261 in stop bar 262 has clearance 265 below stop bolt 215 that enables upward translational movement of stop bar 262, upward rotation of crank 227, and extension of remote locking points 205 while dead bolt 202 is extended. Dead bolt 202 can be extended or retracted regardless of whether remote locking points 205 are extended or retracted. Remote locking points 205 cannot be retracted if dead bolt 202 is extended.

Dead bolt 202 is retracted by a rotation of a thumb turn or thumb turn/lock cylinder (not shown). A spindle as is common in the field protrudes from the thumb turn into slot 248 in dead bolt driver 218. As dead bolt driver 218 rotates, opposite end 255 of dead bolt driver 218 contacts lobe 256 on lifter 257. Lifter 257 is thereby rotated such that upper lobe 258 lifts spring loaded pawl 259 clear of notch 260 on dead bolt 202. Boss 251 on the end of dead bolt driver 218 then rotates to surface 266 in cam slot 252 of dead bolt 202 and driving dead bolt 202 to the retracted position. Simultaneously, gear teeth 217 of dead bolt driver 218 are engaged with rack 216 on stop bolt 215. Stop bolt 15 is driven in a horizontal direction, disengaging protrusion 280 from slot 261 in stop bar 262 and freeing stop bar 262 to move vertically downward and enabling rotation of crank 227.

Figure 13:
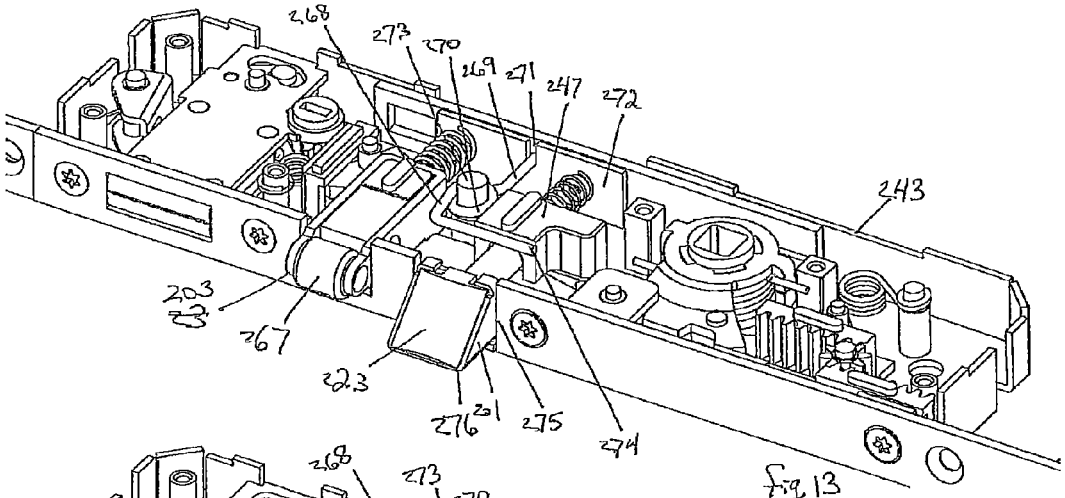
FIG. 13 is a perspective view of the central cassette of the lock assembly of FIG. 1 with the latch bolt in a first rotational position.

It is common in the field to have left hand opening doors and right hand opening doors. It is advantageous for latch bolt 201 and anti-slam plunger 203 to accommodate opposing rotations of the doors either by offering separate hardware with opposing ramps, by offering interchangeability, or by making them non-handed. As depicted in FIG. 13, this is accomplished for anti-slam plunger 203 of embodiments of the invention by incorporating a symmetrical roller 267, thus making it non-handed and functional from either direction.

Figure 14:
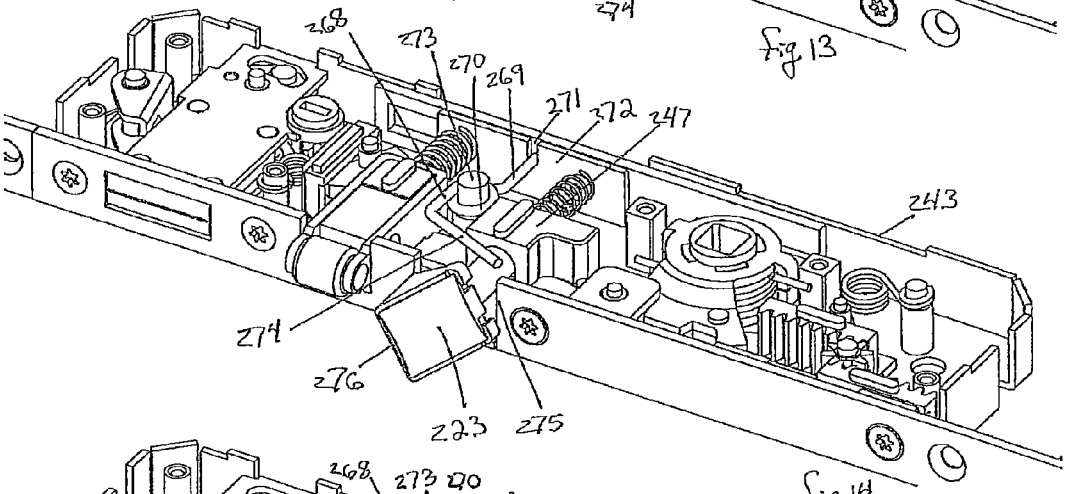
FIG. 14 is a perspective view of the central cassette of the lock assembly of FIG. 1 with the latch bolt in a second rotational position.
Figure 15:
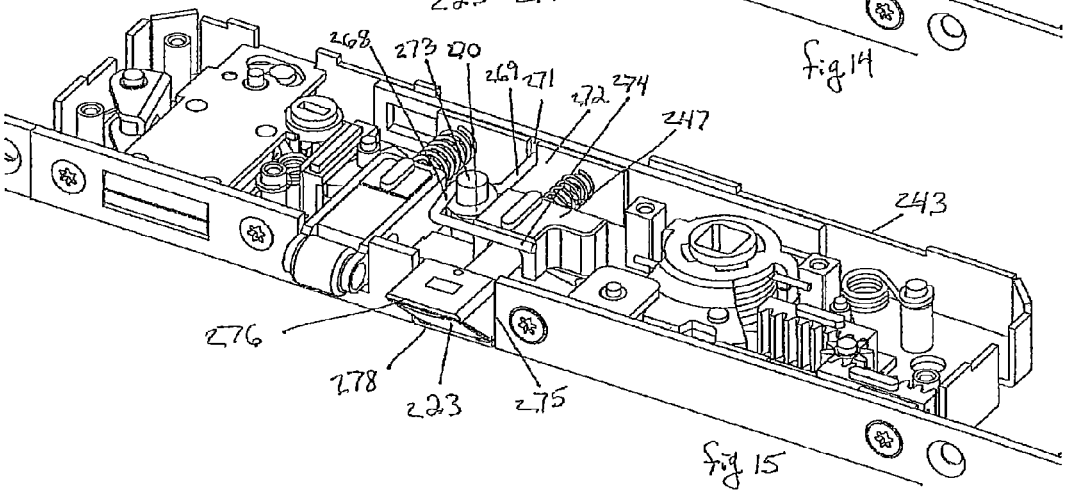
FIG. 15 is a perspective view of the central cassette of the lock assembly of FIG. 1 with the latch bolt in a third rotational position.
Figure 16:
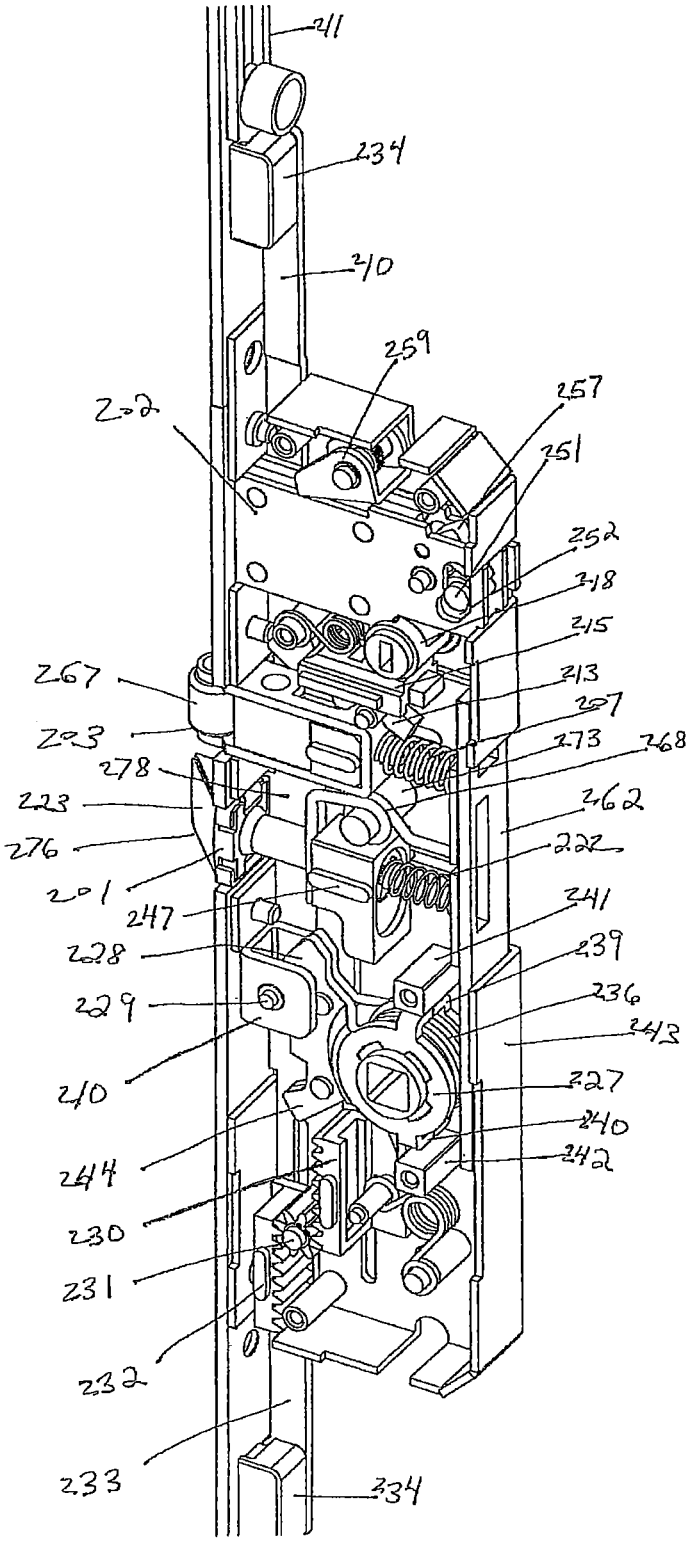
FIG. 16 is a perspective view of the central cassette of the lock assembly of FIG. 1.

As depicted in FIGS. 13, 14, and 15, latch bolt 201 of embodiments of the invention is made interchangeable by restricting the translational movement of the latch bolt 201 with torsion spring 268. Torsion spring 268 has leg 269 extending from central coil 270. Leg 269 engages into notch 271 in bent up wall 272 of cassette housing 243. Central coil 270 wraps around standoff 273 secured to the housing 243, and in the free unloaded position additional leg 274 extends perpendicular to the direction of travel of latch bolt 201. Additional leg 274 of torsion spring 268 limits latch bolt 201 at the extended position so as not to extend beyond the opening 275 in cassette housing 243. Torsion spring 268 will apply a resistance force to latch bolt base 247 as latch bolt end 276 is pulled from and clears housing opening 275. Latch bolt end 276 is then rotated 180 degrees, positioning ramp 223 on latch bolt end 276 for the opposite handed door. Torsion spring 268 is allowed to return to its at rest position, pulling latch bolt end 276 back into housing opening 275. Housing wall 278 and cover wall 279 hold latch bolt end 276 in rotational position.

Figure 17:
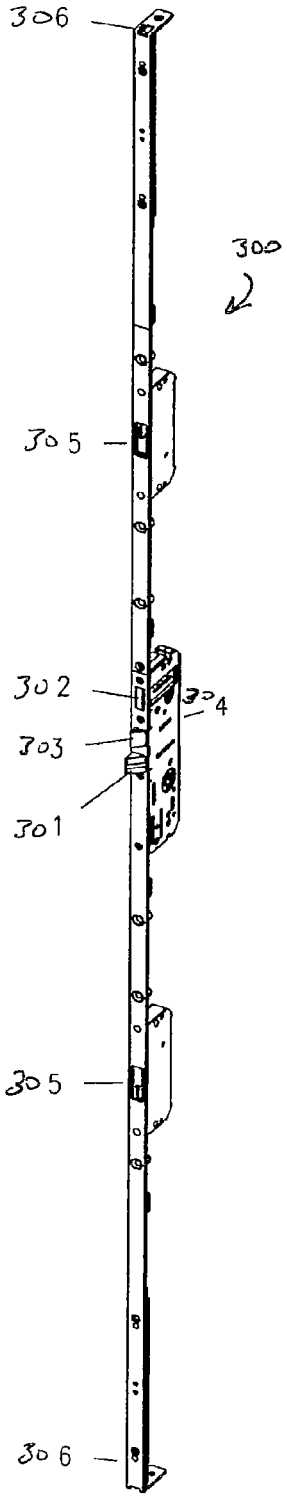
FIG. 17 is a perspective view of a multi-point lock assembly according to another embodiment of the invention.
Figure 18:
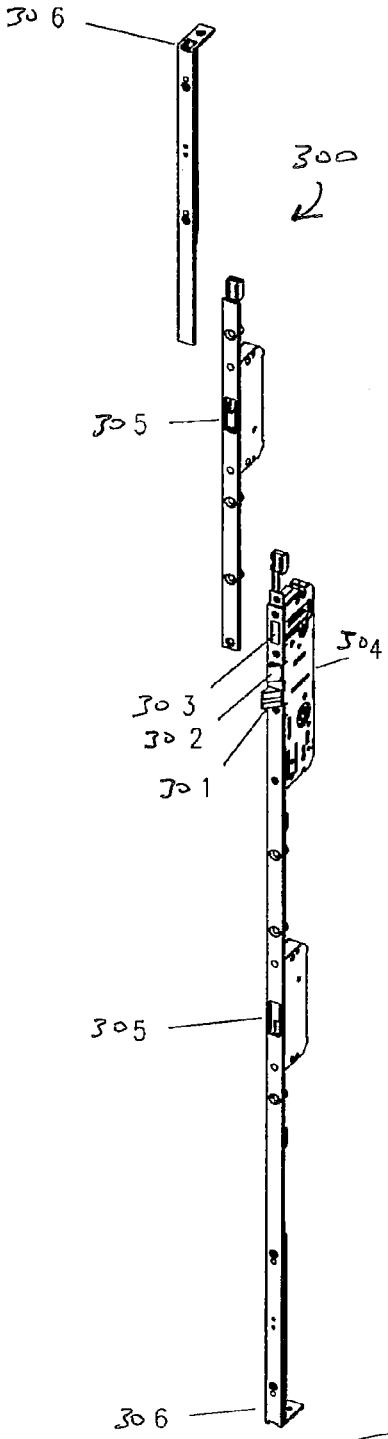
FIG. 18 is another perspective view of the multi-point lock assembly of FIG. 17.
Figure 19:
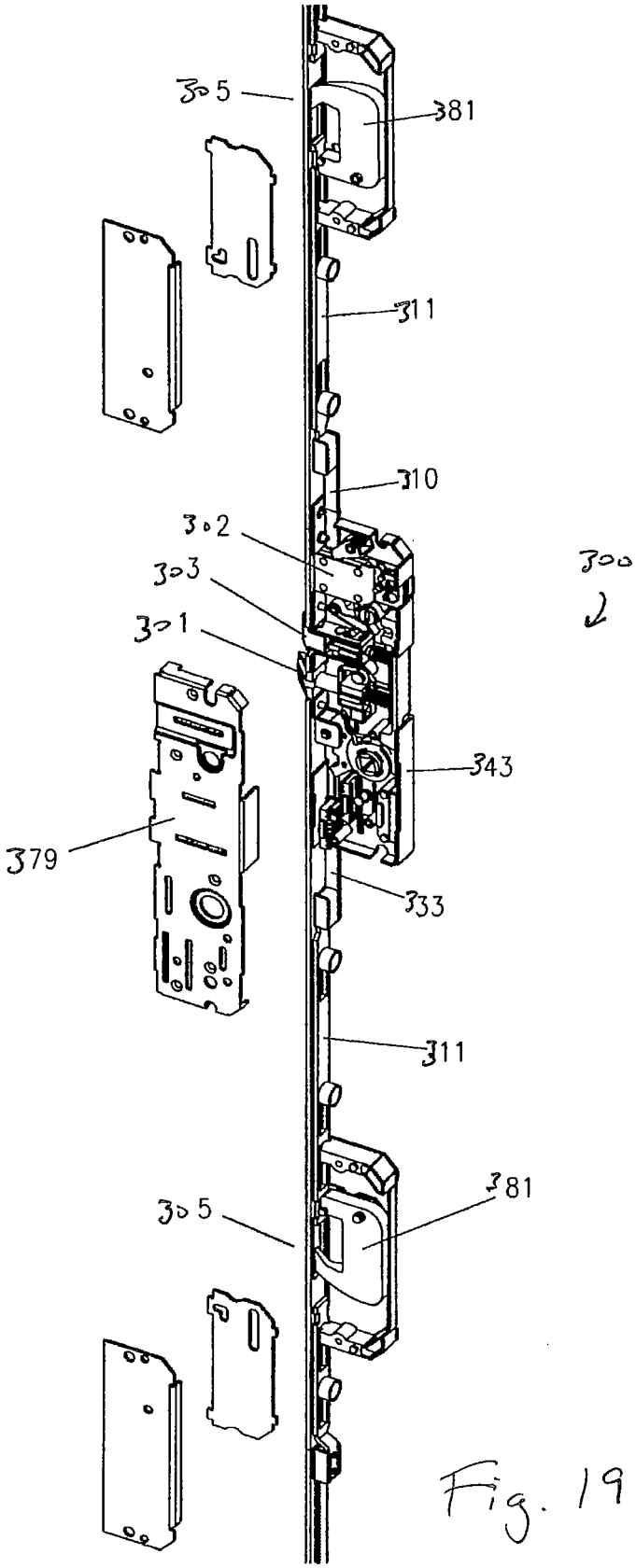
FIG. 19 is a partially exploded view of the lock assembly of FIG. 17.

A lock 300 according to a second embodiment is depicted in FIGS. 17-36 and 1A. Lock 300 may be mounted in the edge of a swinging door 102 as depicted in FIG. 1A. Looking first to FIG. 17, latch bolt 301, dead bolt 302, and anti-slam plunger 303 are disposed in central cassette 304 with two or more remote locking points 305. Remote locking points 305 can be permanently attached to center cassette 304 or attachable as a separate module as depicted in FIG. 18. Locks at remote locking points 305 may be tungs, hooks, bolts, or any other suitable element that extend horizontally into a vertical door frame and may include shoot bolts (not shown) that extend vertically into a horizontal door frame header and threshold. For exemplary purposes, hook 81 is depicted in FIG. 19, but any of the above elements may be added or substituted.

Figure 20:
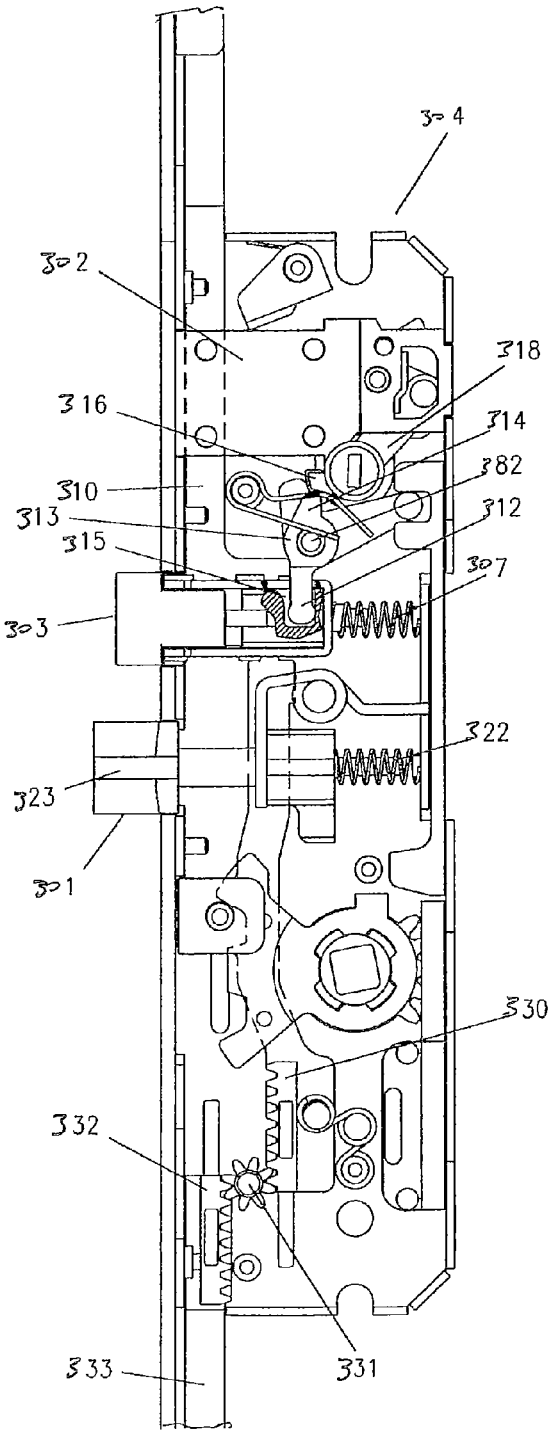
FIG. 20 is a side elevation view of the central cassette of the lock assembly of FIG. 17 with the anti-slam plunger extended.

As depicted in FIG. 20, when door 102 is in the open position, swung away from the door frame, anti-slam plunger 303 protrudes from central cassette 304. Anti-slam plunger 303 is held in an extended position by compression spring 307. Boss 308, shown in FIG. 22, on anti-slam plunger 303 keys into slot 309 in upper operation bar 310 blocking translational movement. Upper operation bar 310 has rack 330 that engages pinion 331, which engages rack 332 in lower operation bar 333. As in FIG. 19, remote locking points 305 are coupled to operation bars 310 and 333 by tie bars 311, and remote locking points 305 are prevented from being extended. As depicted in FIG. 20, blocker link 313 rotates about pin 382. End 312 of blocker link 313 is held in position by slot 315 in the side of anti-slam plunger 303 such that other end 314 of blocker link 313 is positioned with respect to lobe 316 of dead bolt driver 318, thereby preventing dead bolt driver 318 from rotating and extending dead bolt 302.

Figure 21:
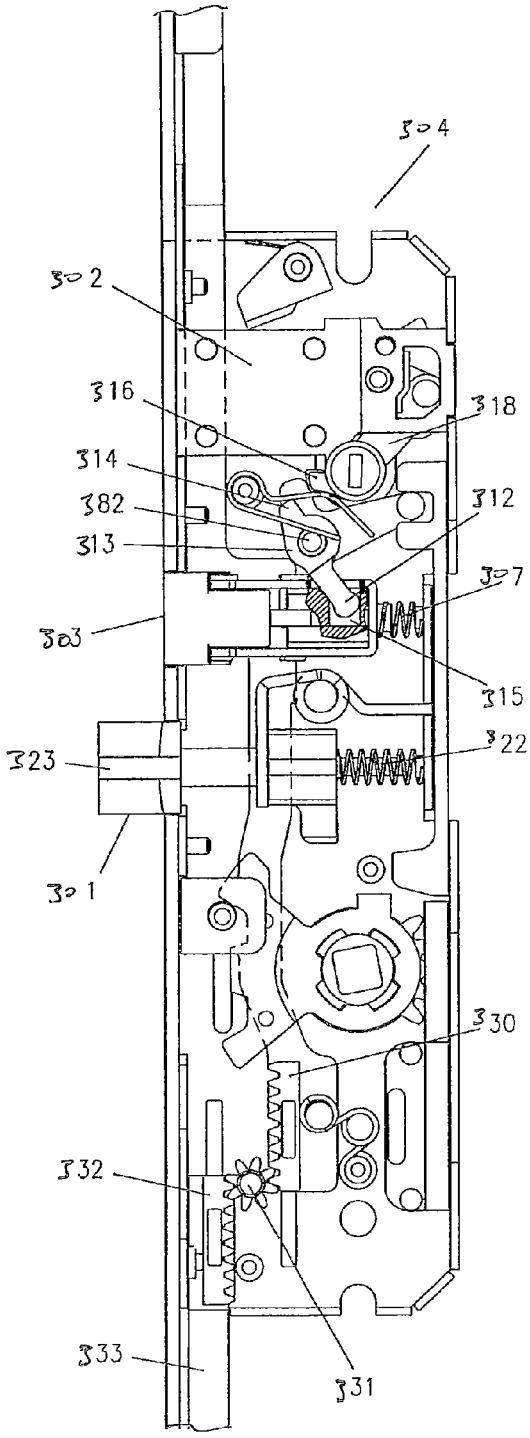
FIG. 21 is a side elevation view of the central cassette of the lock assembly of FIG. 17 with the anti-slam plunger depressed.
Figure 22:
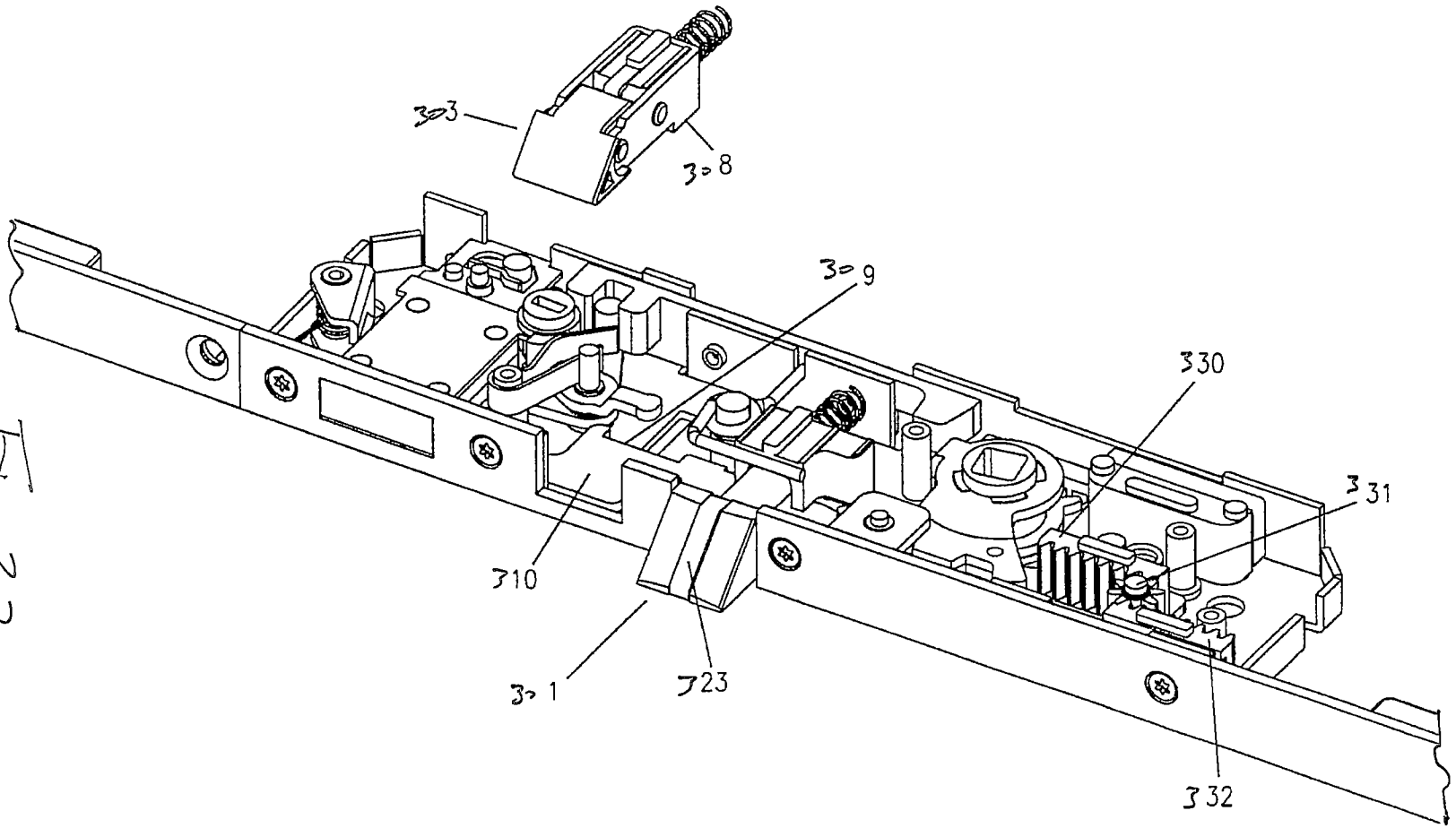
FIG. 22 is a partially exploded perspective view of the central cassette of the lock assembly of FIG. 17.

When door 102 is closed anti-slam plunger 303 contacts a strike in the door frame (not shown) which depresses anti-slam plunger 303 as depicted in FIG. 21. As depicted in FIG. 22, boss 308 of anti-slam plunger 303 clears slot 309 in upper operation bar 310 enabling translational movement of upper operation bar 310 which may in turn drive translation of lower operation bar 333 through racks 330, 332, and pinion 331, thereby resulting in extension of remote locking points 305. As depicted in FIG. 21, slot 315 in anti-slam plunger 303 positions blocker link end 312 so that blocker link 313 rotates about pin 382 and rotates other blocker link end 314 clear of lobe 316 of dead bolt driver 318, thereby enabling rotational movement of dead bolt driver 318 to extend dead bolt 302.

The overall effect is that when door 102 is open, remote locking points 305 and dead bolt 302 are blocked from extending, thus preventing remote locking points 305 and dead bolt 302 from "slamming" into and damaging the door frame as the door is closed. Remote locking points 305 and dead bolt 302 are freed to extend, however, when the door is closed. Compression spring 322 loaded latch bolt 301 has angled ramp surface 323 that causes it to depress as it contacts a strike in the door frame, and extend once it reaches a slot in the strike (not shown) thereby latching the door, similar to other latch bolts common in the field.

Figure 23:
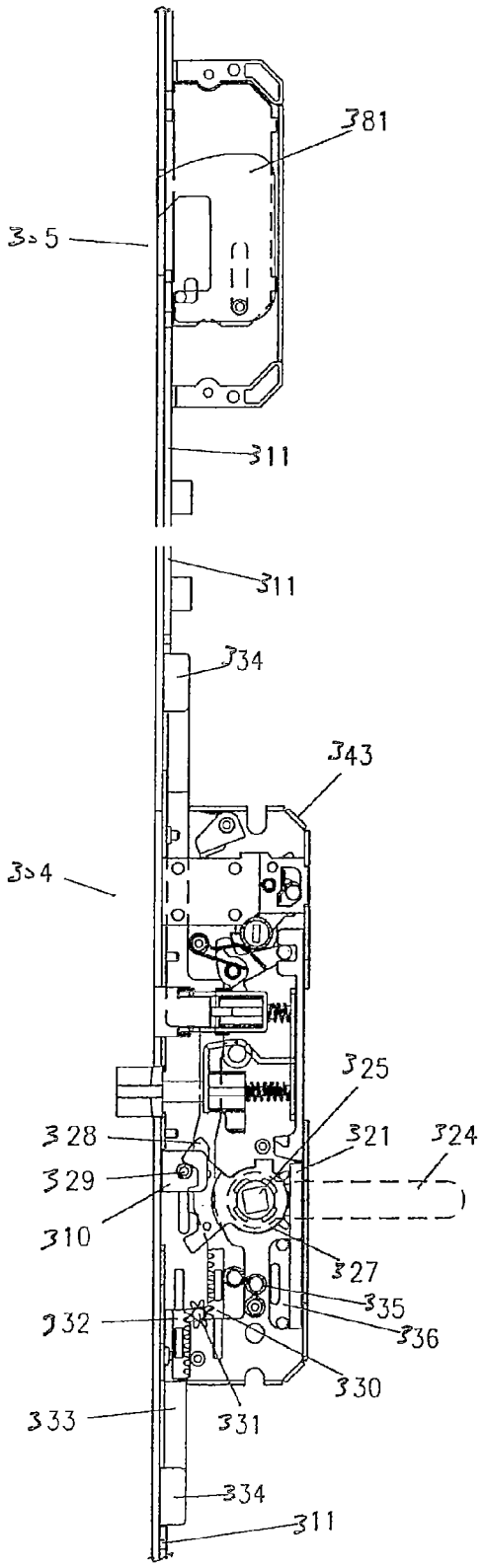
FIG. 23 is a fragmentary side elevation view of the lock assembly of FIG. 17 in a first operational disposition.
Figure 24:
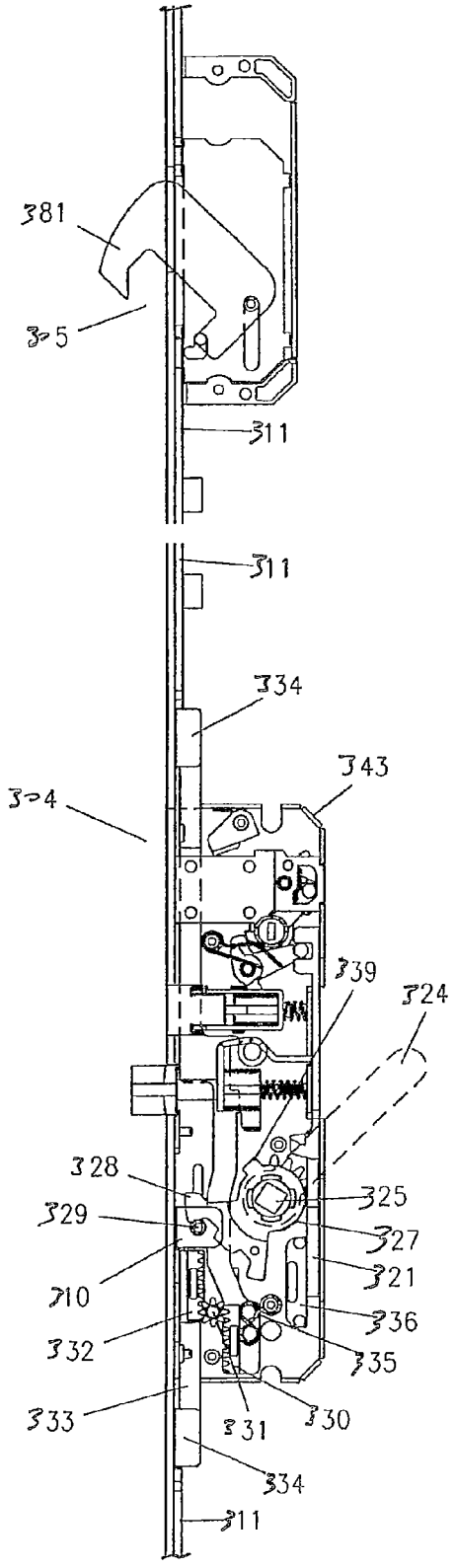
FIG. 24 is a fragmentary side elevation view of the lock assembly of FIG. 17 in a second operational disposition.
Figure 29:
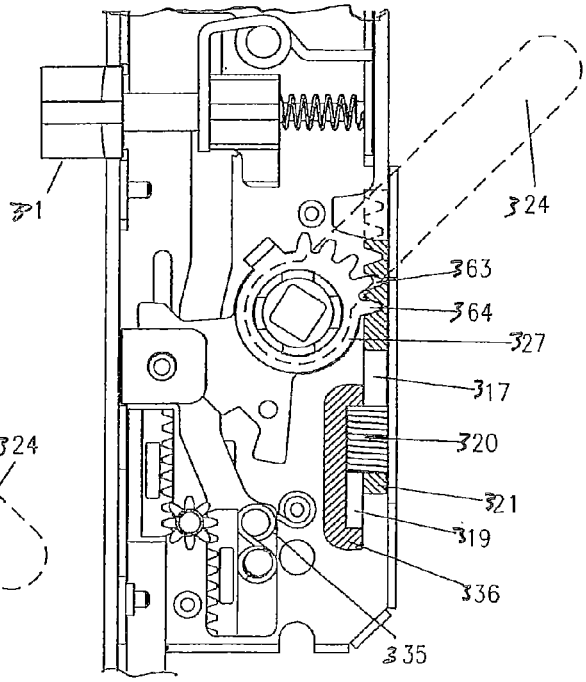
FIG. 29 is a vertical sectional view of the central cassette of the lock assembly of FIG. 17 with the handle in a upward position.

As depicted in FIGS. 23, 24 and 29, remote locking points 305 and/or shoot bolts (not shown) are extended by an upward rotational input from door handle 324, which is keyed to central spindle 325. Spindle 325 protrudes from central cassette 304 and is keyed to crank 327. Crank 327 has upper arm 328 that rotates downward, contacting captured pin 329 in upper operation bar 310 and pushing upper operation bar 310 in a downward direction. Upper operation bar 310 defines rack 330 at its lower end that drives pinion 331 rotationally, which in turn drives rack 332 of lower operation bar 333 in an upward direction. Operation bars 310 and 333 are connected to tie bars 311 by toothed racks 334. Tie bars 311 are coupled to and drive remote locking points 305 to the extended position into strikes located on the door vertical frame and/or, in the case of shoot bolts (not shown), drive the bolts vertically into strikes located on the door frame header or threshold. Simultaneously, gear teeth 364 on crank 327 drive rack 363 in crank return bar 321. Crank return bar 321 defines chamber 317 that longitudinally contains half of compression spring 320. The other half of compression spring 320 is contained in hollow 319 of crank return housing 336. As crank return bar 321 is driven vertically up, the compartment defined by chamber 317 and hollow 319 shrinks, compressing spring 320. As door handle 324 is released, torsion spring 335 biases operation bars 310 and 333 toward the extended position. Compression spring 320 expands the compartment defined by chamber 317 and hollow 319, returning handle 324 to the neutral position. It is important to note that remote locking points 305 and/or shoot bolts (not shown) can be extended in this way regardless of whether dead bolt 302 is extended or retracted.

Figure 25:
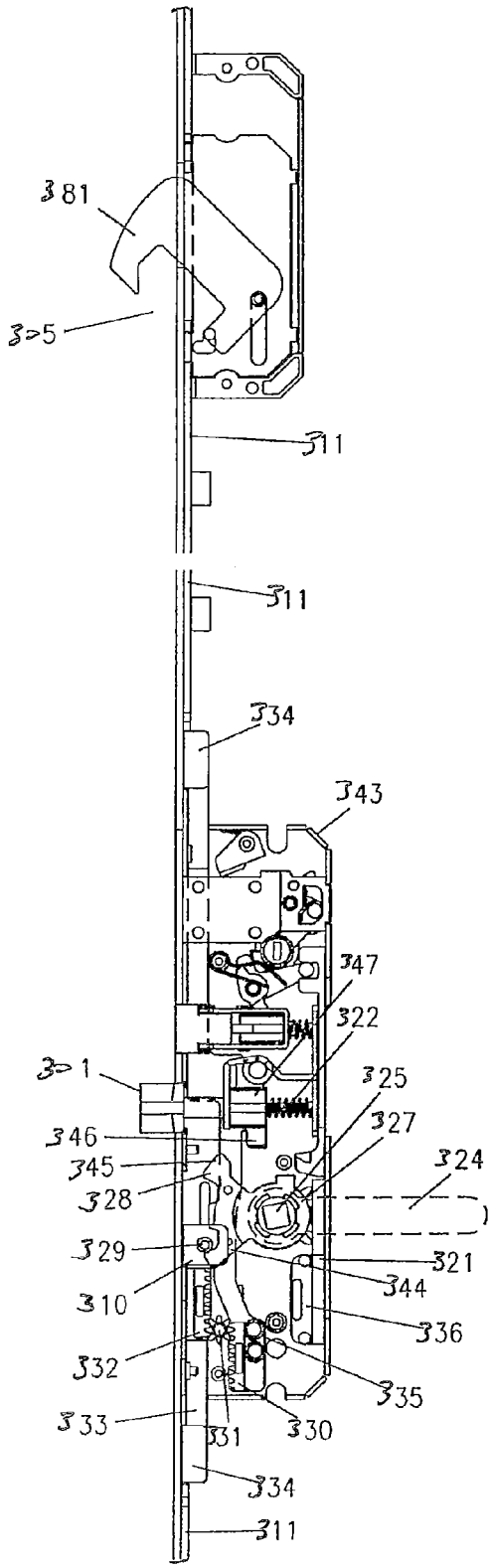
FIG. 25 is a fragmentary side elevation view of the lock assembly of FIG. 17 in a third operational disposition.
Figure 26:
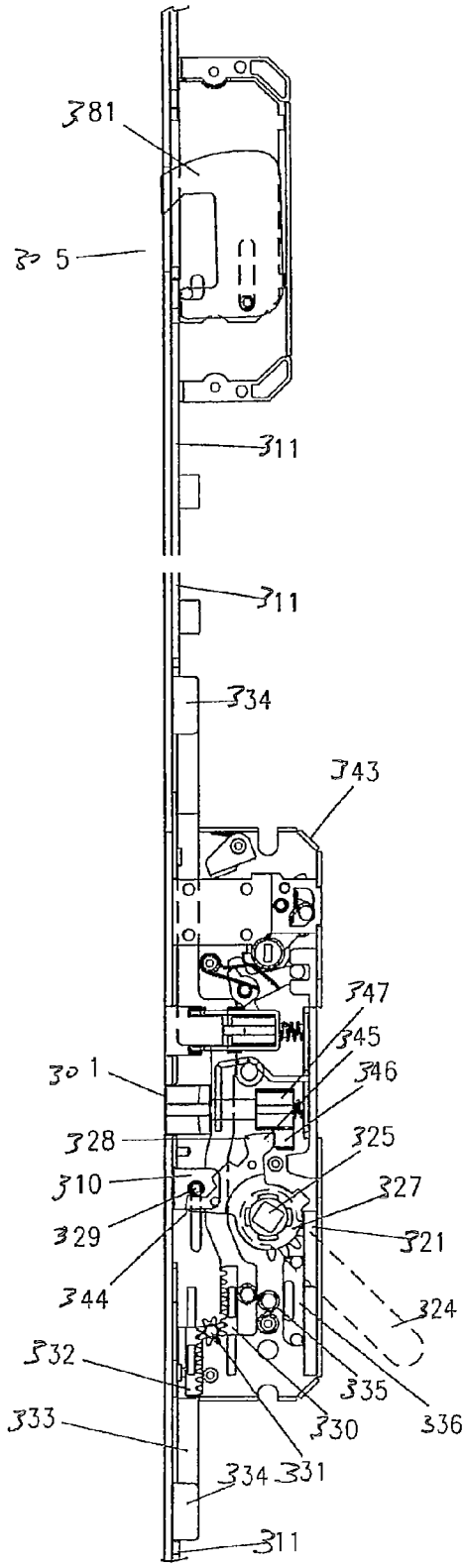
FIG. 26 is a fragmentary side elevation view of the lock assembly of FIG. 17 in a fourth operational disposition.
Figure 27:
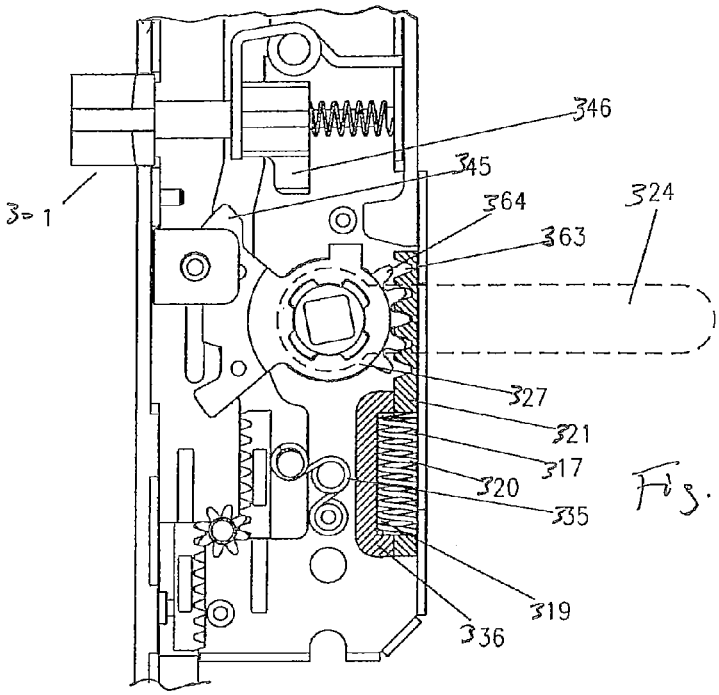
FIG. 27 is a vertical sectional view of the central cassette of the lock assembly of FIG. 17 with the handle in a neutral position.
Figure 28:
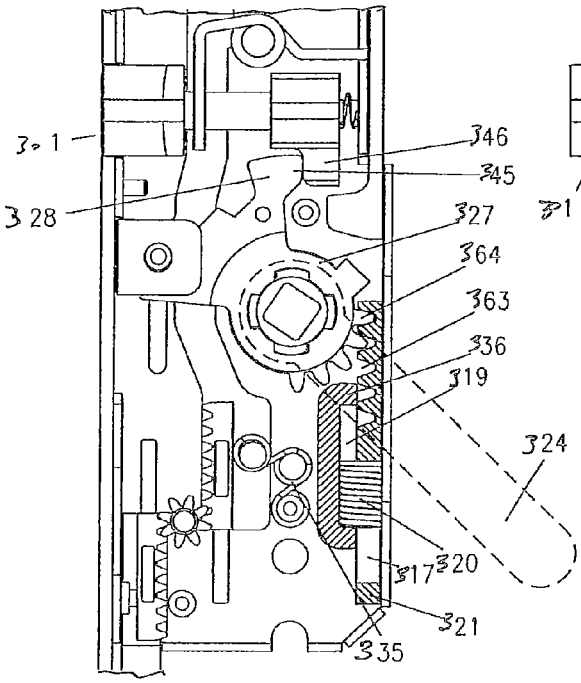
FIG. 28 is a vertical sectional view of the central cassette of the lock assembly of FIG. 17 with the handle in a downward position.

As shown in FIGS. 25 and 26, remote locking points 305 and/or shoot bolts (not shown) are retracted by a downward rotational input from door handle 324, which is keyed to central spindle 325 and which protrudes through and is keyed to crank 327. Crank 327 has lower arm 344 that rotates upward and contacts captured pin 329 in upper operation bar 310, pushing upper operation bar 310 in an upward direction. Rack 330 of upper operation bar 310 drives pinion 331 rotationally, which in turn drives rack 332 in lower operation bar 333 in a downward direction. Operation bars 310 and 333 drive tie bars 311 via toothed racks 334. Tie bars 311 drive remote locking points 305 and/or shoot bolts (not shown) to the retracted position, disengaging remote locking points 305 and/or shoot bolts (not shown) from strikes in the door frame. Simultaneously, crank 327 has lobe 345 on upper arm 328 that contacts corresponding lobe 346 on latch bolt base 347, which retracts latch bolt 301 against the bias of compression spring 322, thereby disengaging latch bolt 301 from strikes in the door frame (not shown). Simultaneously, gear teeth 364 on crank 327 drive rack 363 in crank return bar 321 in a vertically downward direction. Compression spring 320 contained in the shrinking compartment defined by chamber 317 and hollow 319 is compressed. Alternatively, with remote locking points 305 and/or shoot bolts (not shown) in the retracted position, door handle 324 can be rotated downward and latch bolt 301 retracted and compression spring 320 compressed.

As all bolts 301, 302, 305, 306 are retracted, the door 102 may now be rotated to the open position. As anti-slam plunger 303 moves away from the door frame, it is released to the extended position. Boss 308, as shown in FIG. 22, on anti-slam plunger 303 moves into slot 309 on upper operation bar 310, blocking movement of upper operation bar 310 and lower operation bar 333, it effectively blocks extension of remote locking points 305 and/or shoot bolts (not shown).

Simultaneously as depicted in FIGS. 20, 21, and 27-29 slot 315 anti-slam plunger 303 positions end 312 of blocker link 313 such that other end 314 rotates to a position in proximity to lobe 316 of dead bolt driver 318 to prevent dead bolt driver 318 from rotating and driving dead bolt 302. As shown in FIGS. 25 and 26, when door handle 324 is released, torsion spring 335 biases operation bars 310 and 333 toward the retracted position while compression spring 320 drives crank return bar 321 which drives handle 324 back to the neutral position through rack 363 and gear teeth 364 on crank 327. Simultaneously, lobe 345 in upper arm 328 of crank 327 rotates away from latch bolt lobe 346, enabling compression spring 322 to extend latch bolt 301.

Figure 30:
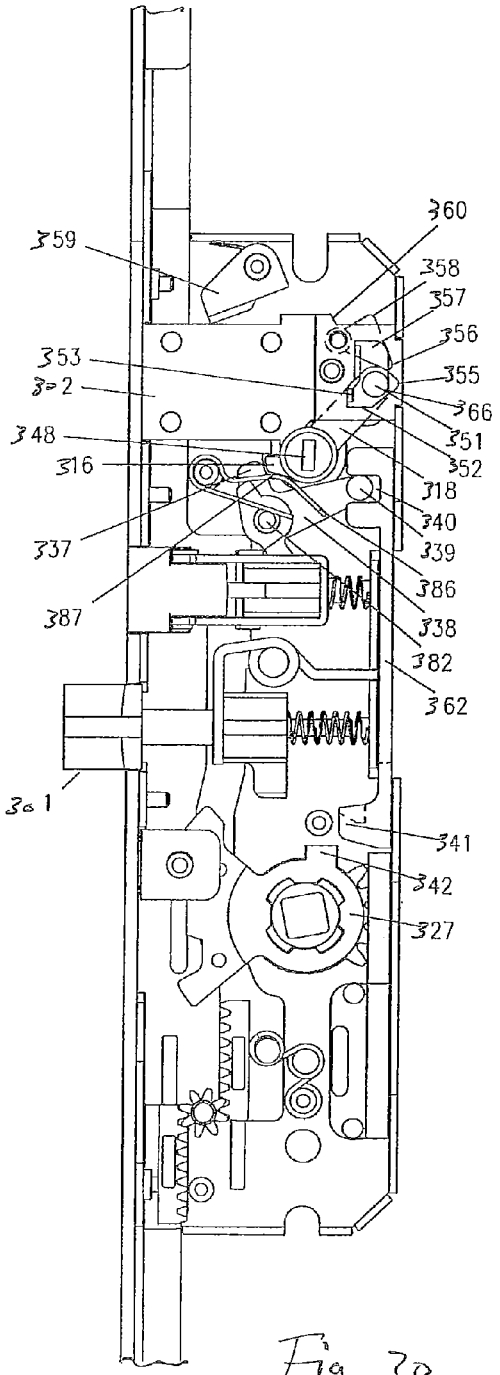
FIG. 30 is a side elevation view of the central cassette of the lock assembly of FIG. 17 with the dead bolt in a retracted position.
Figure 31:
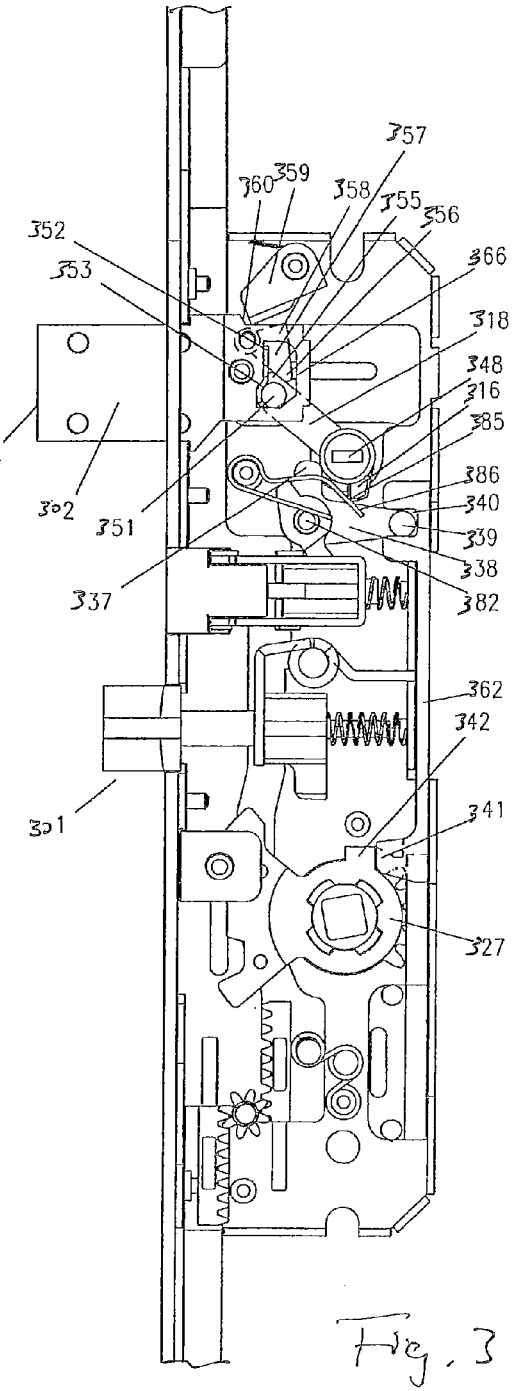
FIG. 31 is a side elevation view of the central cassette of the lock assembly of FIG. 17 with the dead bolt in an extended position.

As depicted in FIGS. 30 and 31, dead bolt 302 may be extended by a rotation of a thumb turn or thumb turn/lock cylinder common in the field (not shown). A spindle protrudes from the thumb turn into a slot 348 in dead bolt driver 318. As dead bolt driver 318 rotates, boss 351 on opposite end 355 fits into cam slot 352 to drive dead bolt 302 in a horizontal translational motion. Cam slot 352 presents surface 353 oriented such that as dead bolt 302 reaches its maximum extension, boss 351 on dead bolt driver 318 reaches a toggle position in cam slot 352, blocking dead bolt 302 from being back driven by a force placed on end surface 354 of dead bolt 302 parallel to the dead bolt translational motion.

Simultaneously, as dead bolt driver 318 rotates, opposite end 355 of dead bolt driver 318 pushes lobe 356 on lifter 357 in a rotational motion such that upper lobe 358 contacts and lifts spring loaded pawl 359. As dead bolt 302 reaches full extension, lifter 357 is enabled to rotate down, dropping pawl 359 below notch 360 in dead bolt 302 to assist in blocking dead bolt 302 from being back driven. Simultaneously, lobe 316 of dead bolt driver 318 rotates away from end 337 of link 338, enabling link 338 to rotate about pin 382, and enabling boss 339 on another end of link 338 to rotate down. Slot 340 in stop bar 362 is positioned by boss 339 such that when boss 339 rotates downward, stop bar 362 moves vertically downward such that blocking lobe 341 at the other end of stop bar 362 moves in proximity with tab 342 on crank 327, blocking rotation of crank 327 and inhibiting handle 324 from retracting latch bolt 301, remote locking points 305, and/or shoot bolts (not shown).

It is important to note that the dead bolt 302 can be extended or retracted regardless of whether the remote locking points 305 are extended or retracted. Simultaneously, lobe 316 of dead bolt driver 318 has corner 385 that is held in position by flat spring 386.

Dead bolt 302 is retracted by a rotation of the thumb turn or thumb turn/lock cylinder common in the field (not shown). A spindle protrudes from the thumb turn into slot 348 in dead bolt driver 318. As dead bolt driver 318 rotates, opposite end 355 of dead bolt driver 318 contacts lobe 356 on lifter 357, rotating lifter 357 such that upper lobe 358 lifts spring loaded pawl 359 clear of notch 360 on dead bolt 302. The timing is such that boss 351 on the end of dead bolt driver 318 then rotates to surface 366 in cam slot 352 of dead bolt 302, driving dead bolt 302 to the retracted position. Simultaneously, as dead bolt driver 318 rotates to retract the dead bolt 302, lobe 316 on dead bolt driver 318 contacts end 337 of link 338, rotating boss 339 up which pushes slot 40 up lifting crank stop 62 vertically upward. This moves blocking lobe 341 away from tab 342 on crank 327, enabling rotation of crank 327. Simultaneously, lobe 316 on dead bolt driver 318 has surface 387 that is held in position by flat spring 386.

It is common in the field to have left hand rotating doors and right hand rotating doors (not shown). Latch bolt 301 and anti-slam plunger 303 must be able to accommodate the opposing rotations of the doors either by offering separate hardware with opposing ramps, by offering interchangeability, or by making them non-handed.

Figure 32:
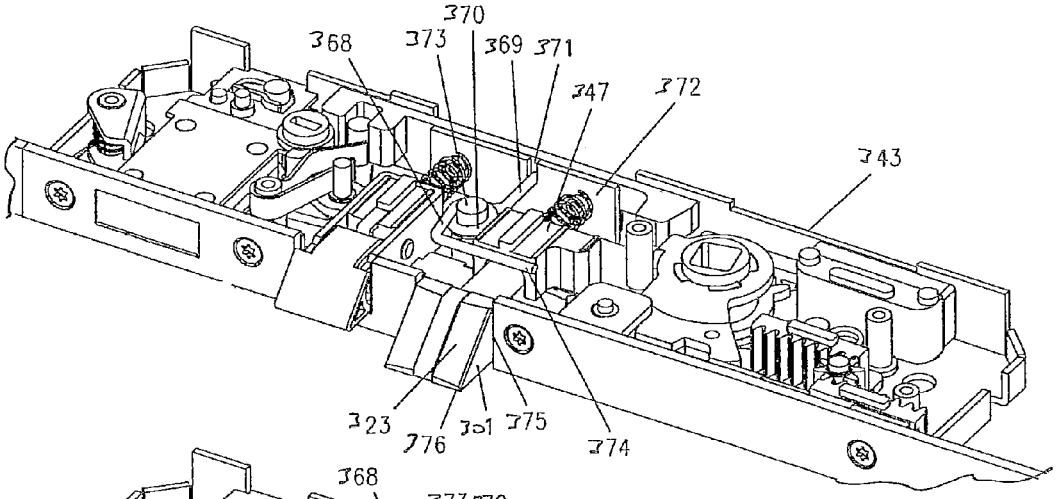
FIG. 32 is a perspective view of the central cassette of the lock assembly of FIG. 17 with the latch bolt in a first rotational position.
Figure 33:
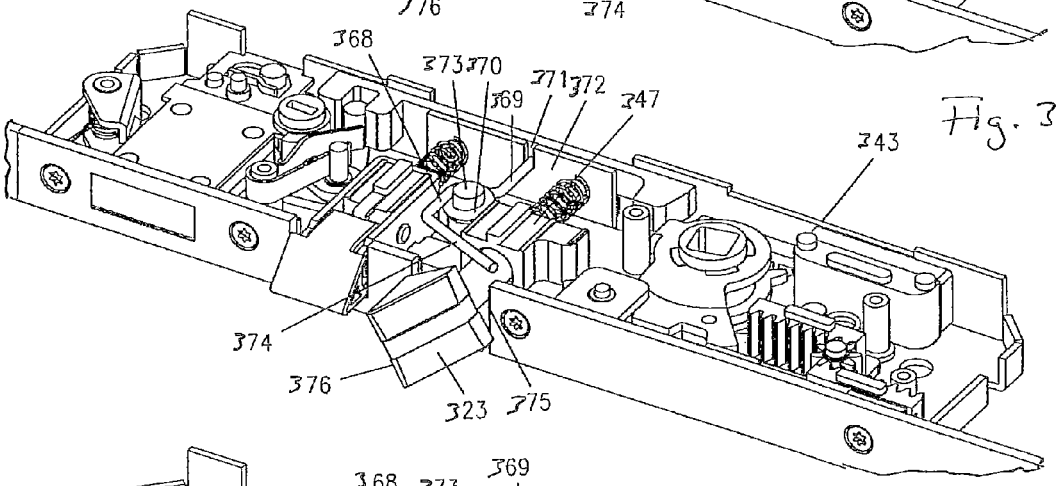
FIG. 33 is a perspective view of the central cassette of the lock assembly of FIG. 17 with the latch bolt in a second rotational position.
Figure 34:
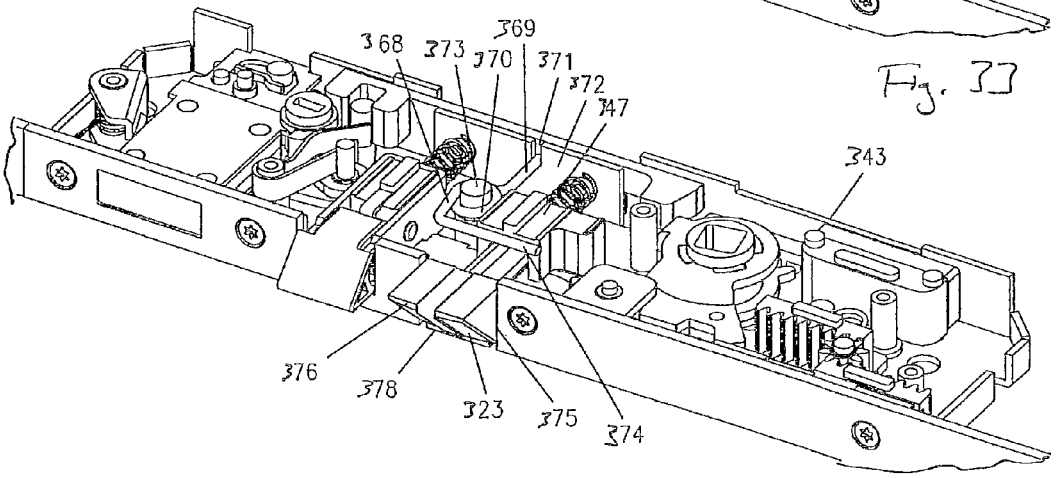
FIG. 34 is a perspective view of the central cassette of the lock assembly of FIG. 17 with the latch bolt in a third rotational position.

As depicted in FIGS. 32, 33, and 34, latch bolt 301 of this embodiment is made interchangeable by restricting the translational movement of latch bolt 301 with torsion spring 368. Torsion spring 368 has leg 369 extending from central coil 370, which inserts into notch 371 in bent up wall 372 in cassette housing 343. Central coil 370 wraps around standoff 373 secured to housing 343 and, in the free unloaded position, additional leg 374 extends perpendicular to the direction of travel of latch bolt 301. This additional leg 374 of torsion spring 368 constrains latch bolt 301 at the extended position so as not to extend beyond the opening 375 in cassette housing 343. Torsion spring 368 applies a resistance force to latch bolt base 347 as latch bolt end 376 is pulled from and clears housing opening 375. Latch bolt end 376 is then rotated 180 degrees, positioning ramp 323 on latch bolt end 376 for the opposite handed door. Torsion spring 368 is allowed to return to its at rest position, pulling latch bolt end 376 back into housing opening 375. Housing wall 378 and cover wall 379 hold latch bolt end 376 in rotational position.

Figure 35:
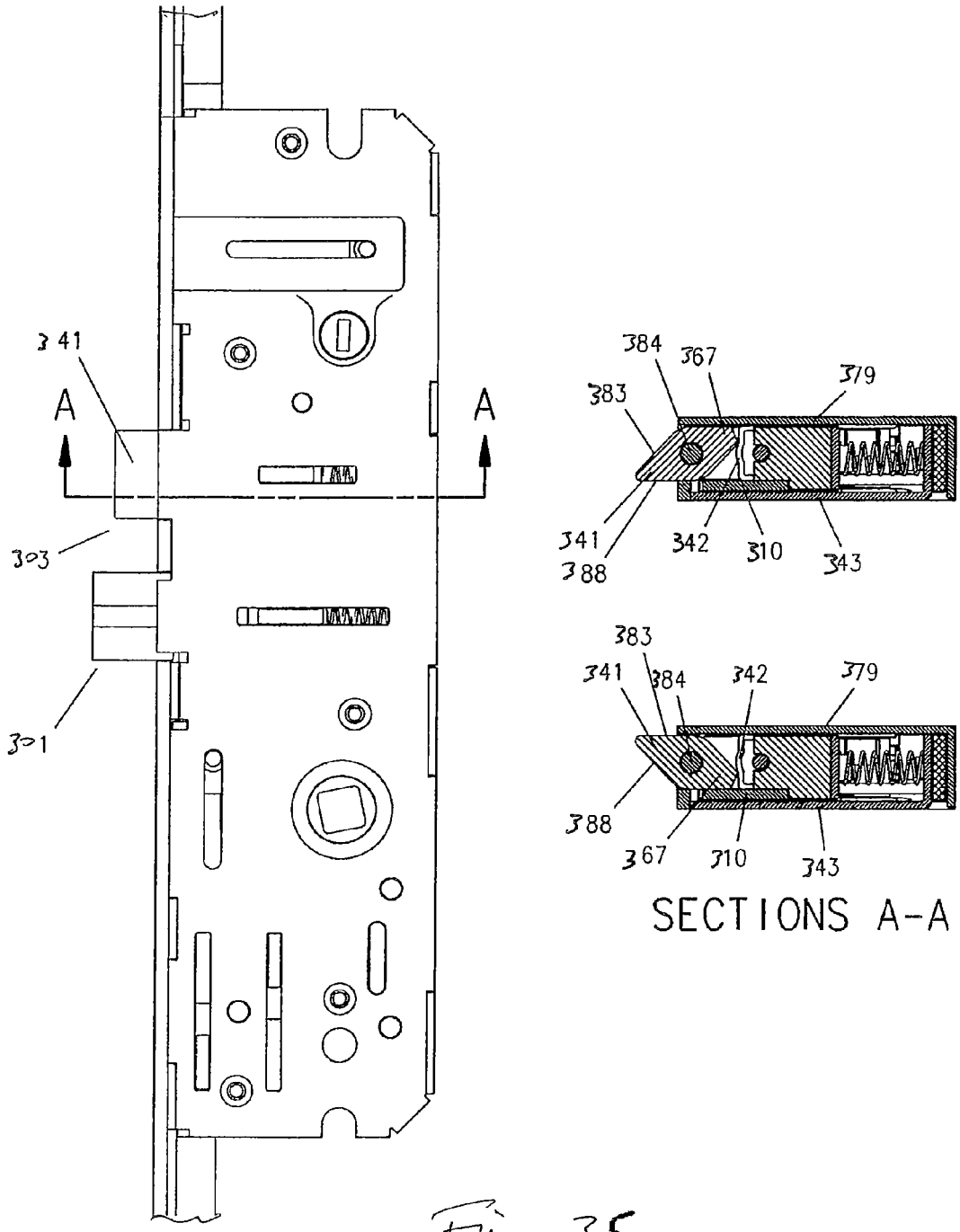
FIG. 35 is a sectional view of the lock cassette of FIG. 17 taken through section A-A with the anti-slam plunger configured in two different positions according to an embodiment of the invention.
Figure 36:
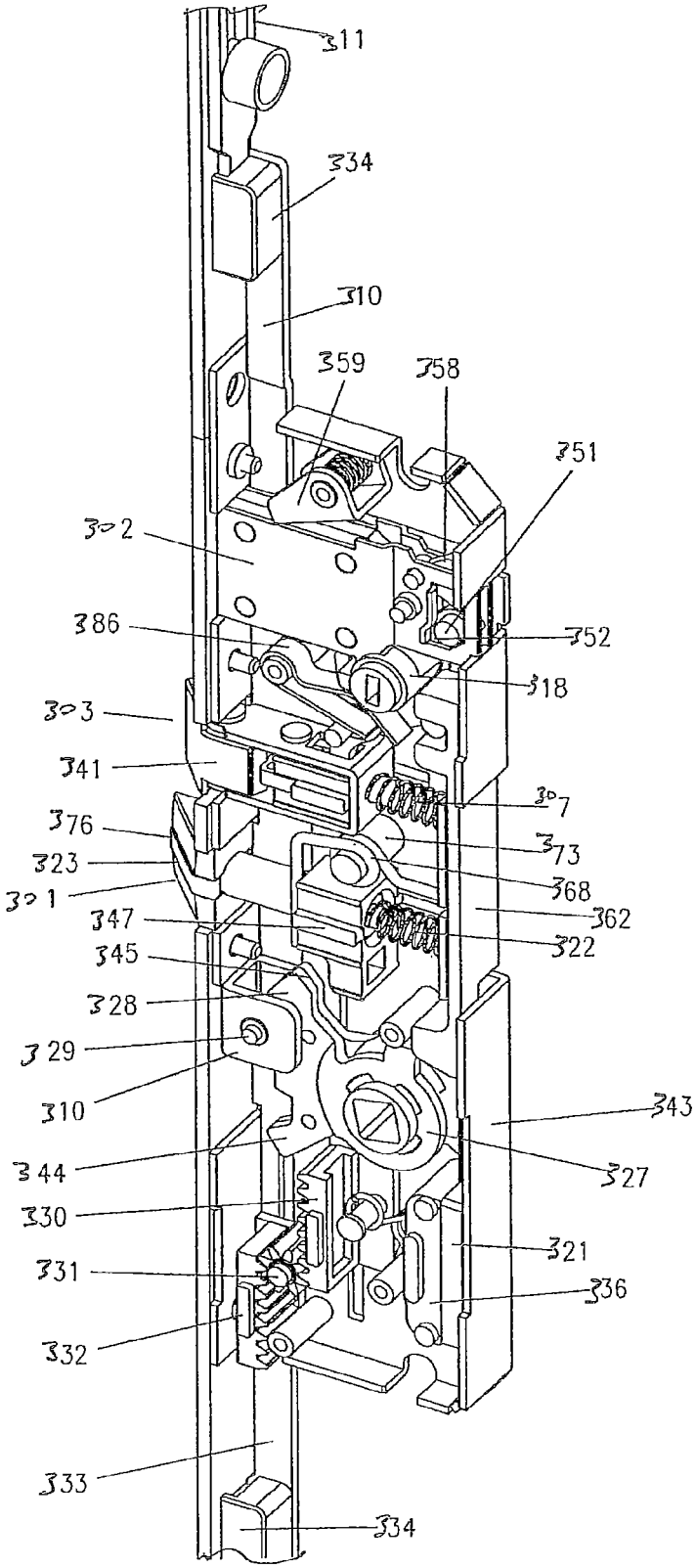
FIG. 36 is a perspective view of the central cassette of the lock assembly of FIG. 17.
Figure 37:
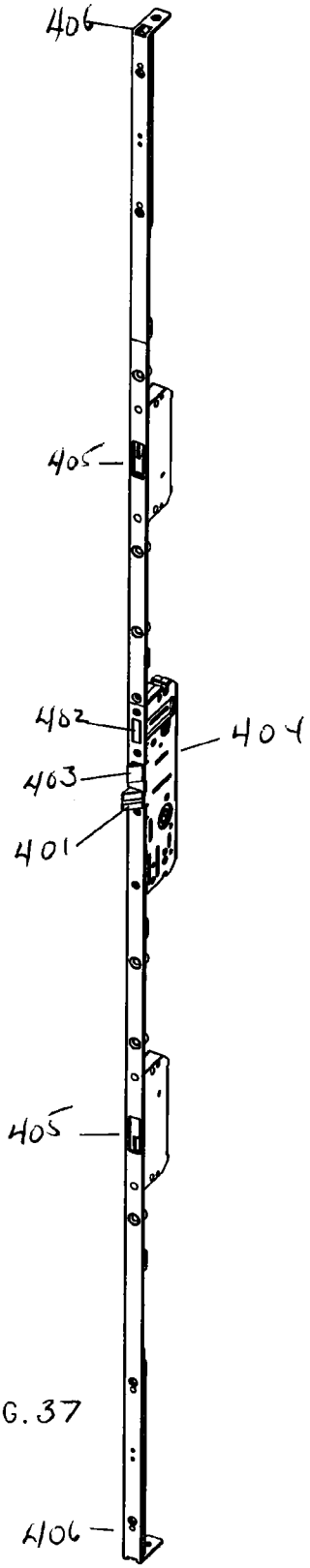
FIG. 37 is a perspective view of a multi-point lock assembly according to another embodiment of the invention.

As shown in FIG. 35, accommodation of left handed and right handed doors is accomplished in anti-slam plunger 303 of this embodiment with rotating paddle 341 that rotates about pin 384. As depicted in FIG. 35, surface 383 of paddle 341 acts as the ramp for a left handed door. Detent 342 bears against end 367, holding paddle 341 in place. As shown in FIG. 34, paddle 341 has rotated such that end 367 is held by detent 342 so that surface 388 now acts as the ramp surface for a right handed door, effectively making anti-slam plunger 303 non-handed.

Figure 38:
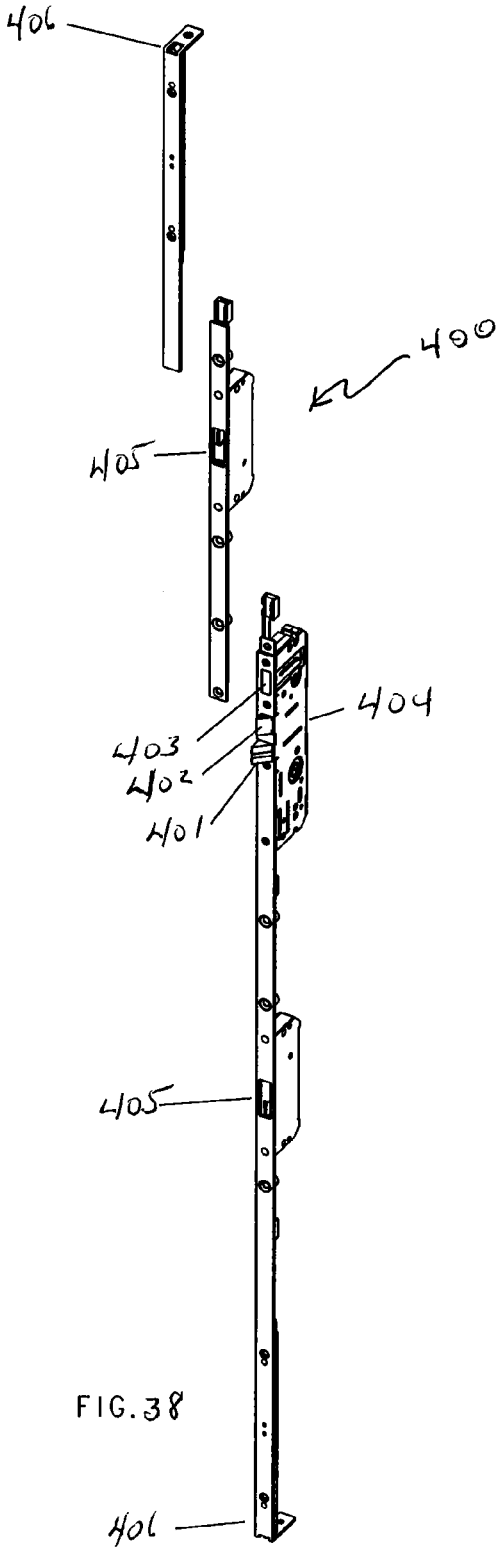
FIG. 38 is another perspective view of the multi-point lock assembly of FIG. 37.

Referring to FIGS. 37-59 another embodiment of lock assembly 400 is depicted. In the depicted embodiment, latch bolt 401, dead bolt 402, and anti-slam plunger 403 are located in central cassette 404 with two or more remote locking points 405. Remote locking points 405 can be permanently attached to center cassette 404 or attachable as a separate module as depicted in FIG. 38. Locks at the remote locking points 405 may be tungs, hooks, bolts, etc. that extend horizontally into a vertical door frame and/or may include shoot bolts (not shown) that extend vertically into a horizontal door frame header and threshold.

Figure 39:
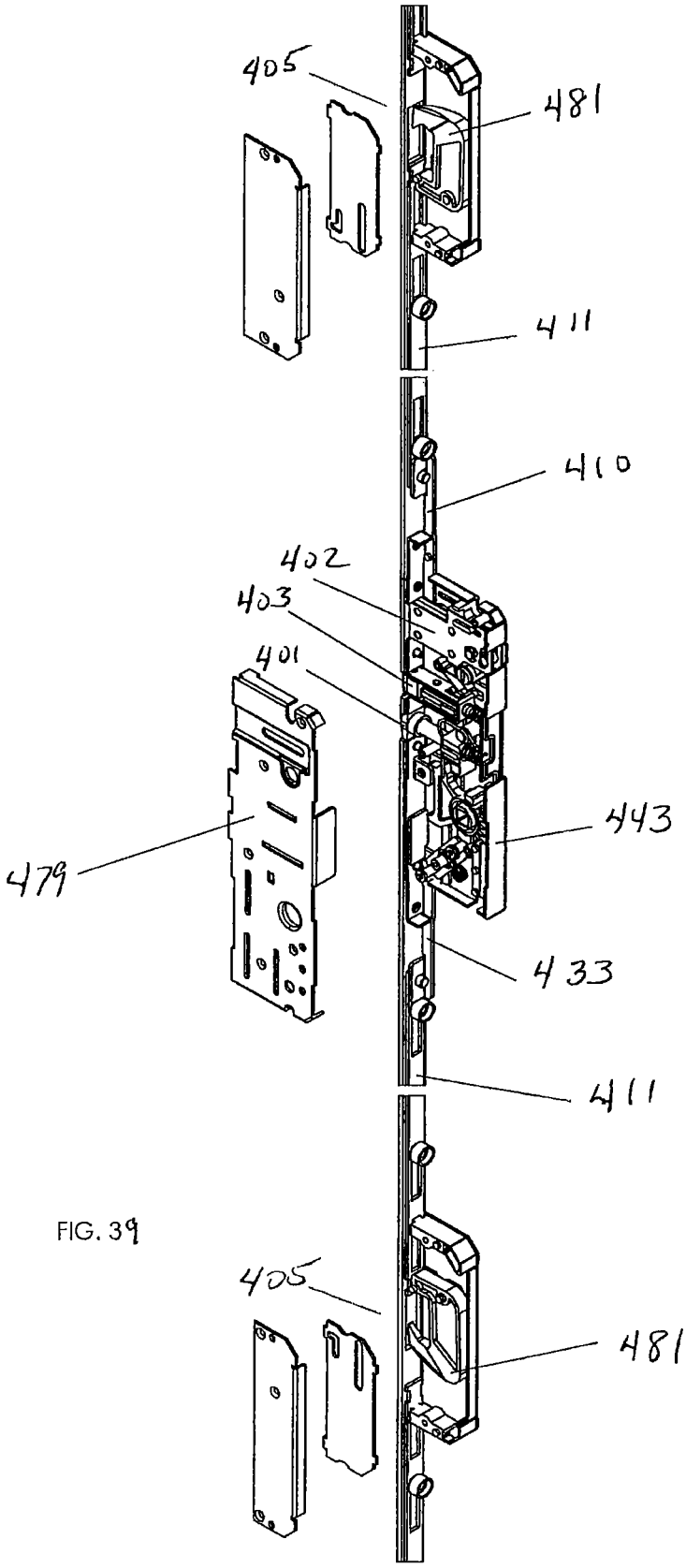
FIG. 39 is a partially exploded view of the lock assembly of FIG. 37.

FIG. 39 depicts an example remote locking point 405, hook 481 that is common in the field. This example should not be considered limiting. Remote locking points may include any type of remote locking point 405 known in the art.

Figure 40:
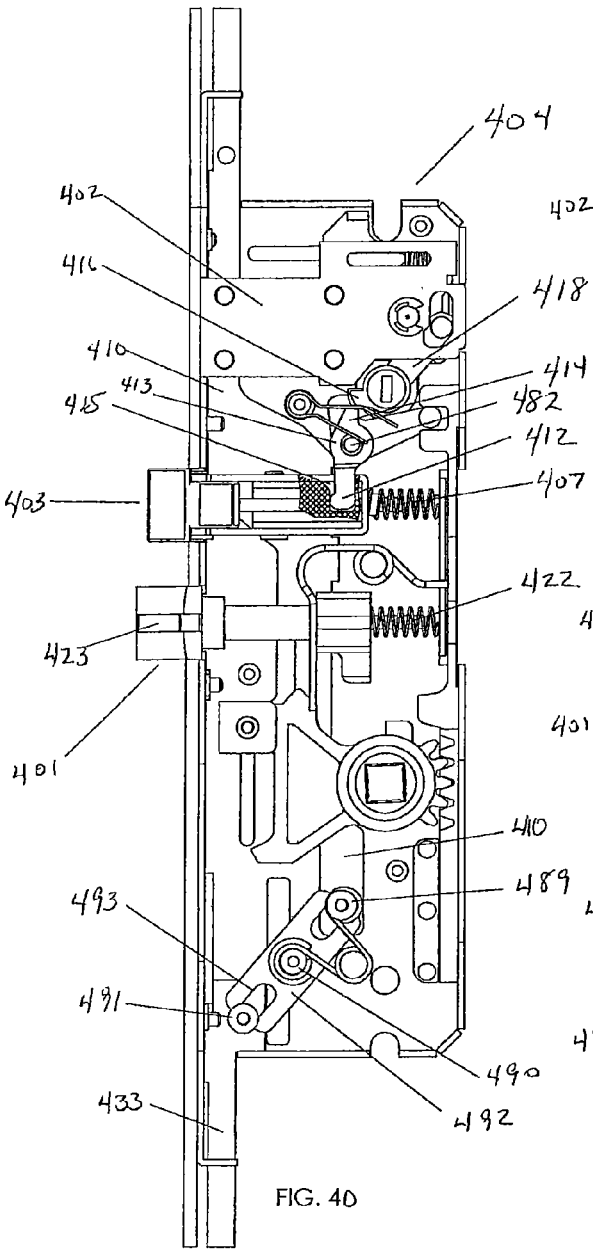
FIG. 40 is a side elevation view of the central cassette of the lock assembly of FIG. 37 with the anti-slam plunger extended.

Referring to FIG. 40, when a swinging door is in the open position, swung away from the door frame, anti-slam plunger 403 protrudes from the central cassette 404. In this example, anti-slam plunger 403 is held in an extended position by compression spring 407.

Figure 42:
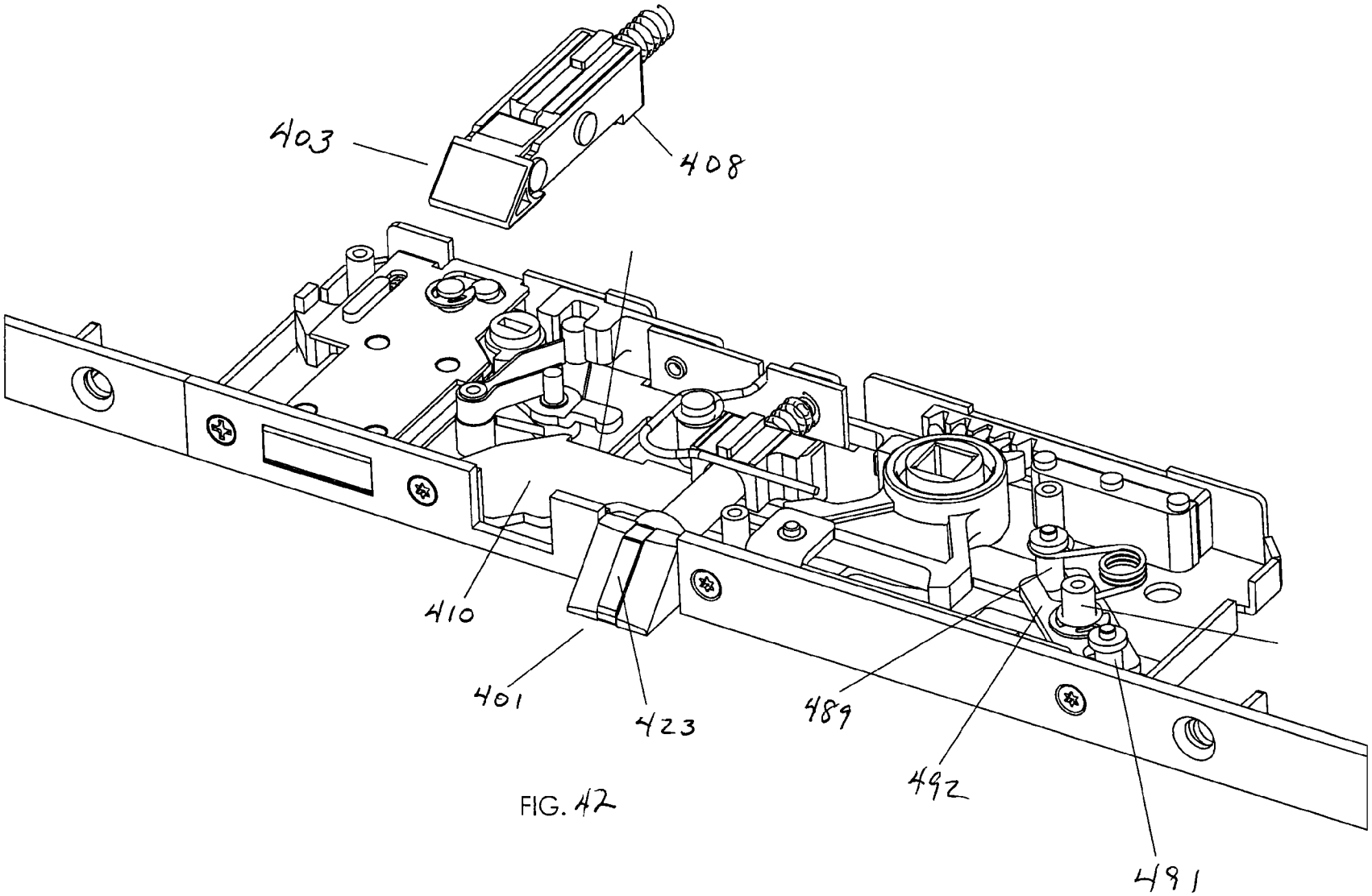
FIG. 42 is a partially exploded perspective view of the central cassette of the lock assembly of FIG. 37.

Referring to FIG. 42, boss 408, on anti-slam plunger 403, keys into slot 409 in upper operation bar 410 blocking translational movement of upper operation bar 410 when anti-slam plunger 403 is in an extended position. Upper operation bar 410 includes lower pin 489 that engages lever 492 via one of two slots 493. Lever 492 is pivotally coupled at pivot pin 490. Opposing slot 493 of lever 492 engages pin 491 and lower operation bar 433.

Referring to FIG. 39, remote locking points 405 are coupled to operation bars 410 and 433 by tie bars 411 whereby remote locking points 405 are prevented from being extended. Simultaneously, referring to FIG. 40, blocker link 413 rotates about pin 482. End 412 of blocker link 413 is held in position by slot 415 in the side of anti-slam plunger 403 such that other end 414 of blocker link 413 is positioned with respect to lobe 416 of dead bolt driver 418 to prevent dead bolt driver 418 from rotating and extending dead bolt 402.

Figure 41:
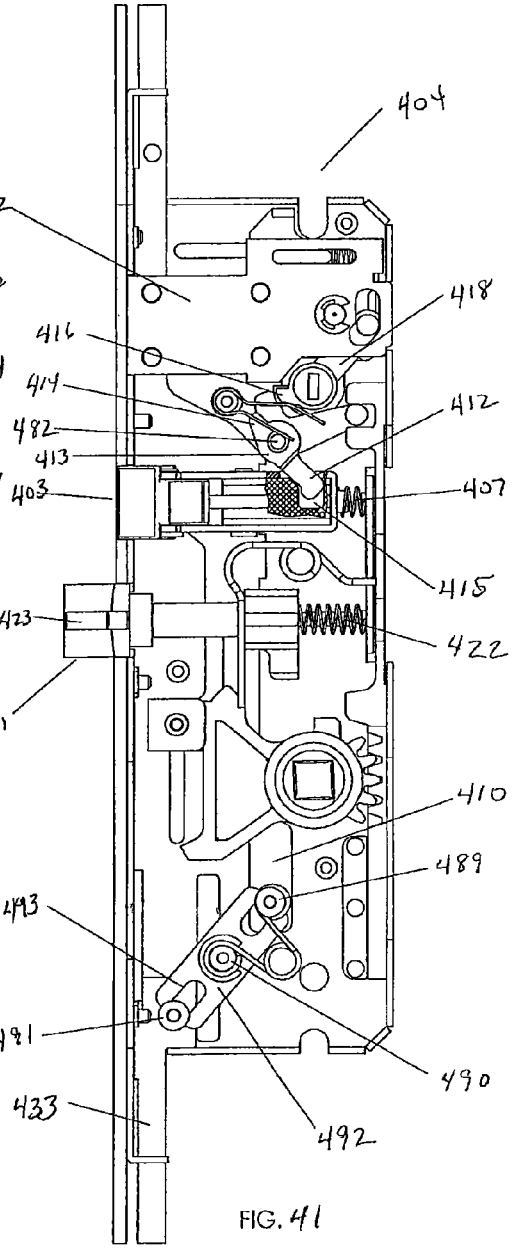
FIG. 41 is a side elevation view of the central cassette of the lock assembly of FIG. 37 with the anti-slam plunger depressed.

Referring to FIG. 41, the door is closed and anti-slam plunger 403 comes into contact with a strike in the door frame (not shown) which depresses anti-slam plunger 403 inwardly into central cassette 404. Boss 408, best seen in FIG. 42, on anti-slam plunger 403 clears slot 409 in upper operation bar 410 allowing translational movement of upper operation bar 410 which then drives lower operation bar 433 in the opposite direction through lever 492 and pins 490, 491 thus extending remote locking points 405. Simultaneously, as depicted in FIG. 41, slot 415 in the anti-slam plunger 403 positions blocker link end 412 so that blocker link 413 rotates about pin 482 thus rotating other blocker link end 414 clear of lobe 416 of dead bolt driver 418 thus allowing rotational movement of dead bolt driver 418 to extend dead bolt 402 from central cassette 404.

The effect of this operation is that when the door is open, remote locking points 405 and dead bolt 402 are blocked from extending, thus preventing remote locking points 405 and dead bolt 402 from "slamming" into and damaging the door frame as the door is closed. However, remote locking points 405 and dead bolt 402 are freed to extend when the door is closed to secure the door in the closed position.

Latch bolt 401 is biased toward an extended position by compression spring 422. Compression spring 422 loaded latch bolt 401 presents angled ramp surface 423 that causes latch bolt 401 to depress as it contacts a strike in the door frame, and to extend once it reaches a slot in the strike (not shown) latching the door, similar to latch bolts common in the field.

Figure 43:
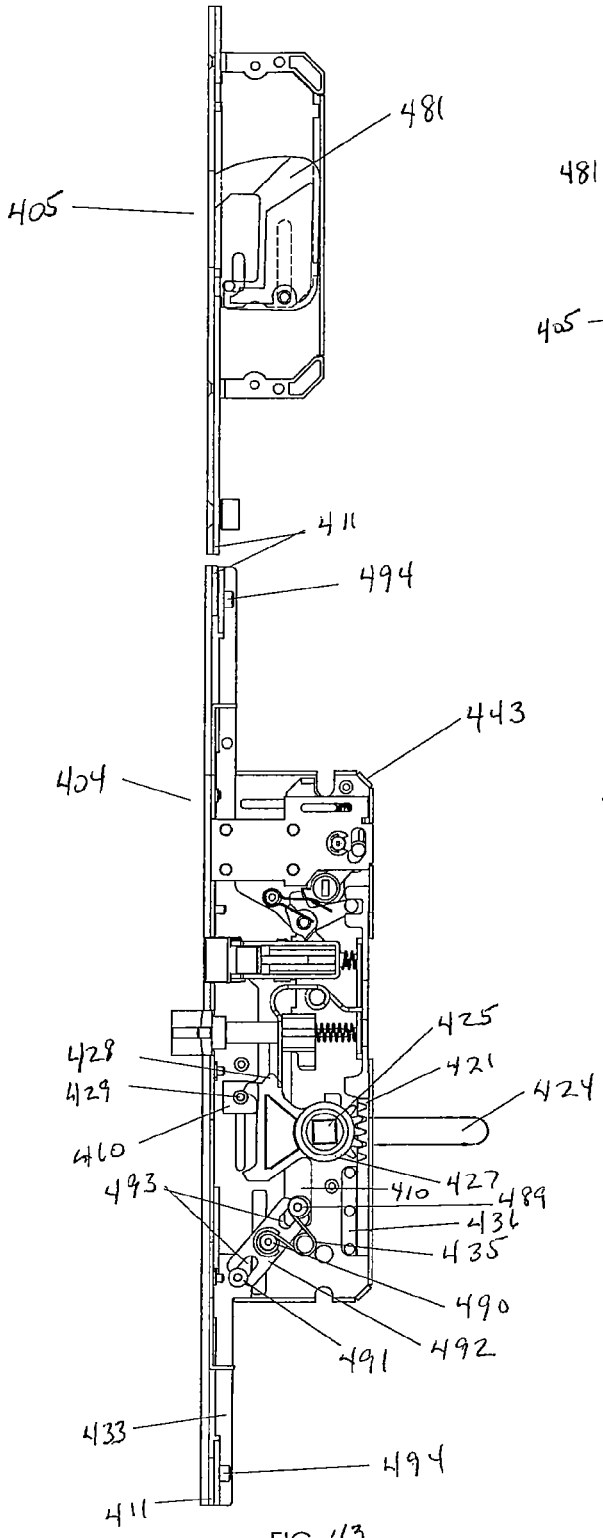
FIG. 43 is a fragmentary side elevation view of the lock assembly of FIG. 37 in a first operational disposition.
Figure 44:
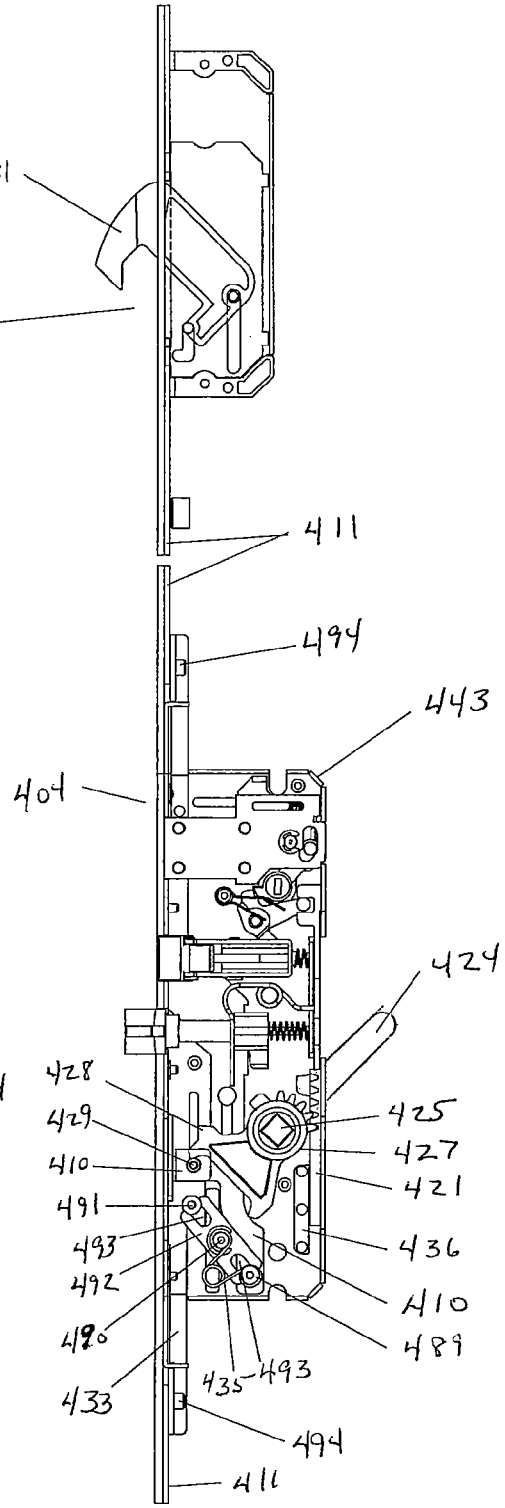
FIG. 44 is a fragmentary side elevation view of the lock assembly of FIG. 37 in a second operational disposition.

Referring to FIGS. 43 and 44, remote locking points 405 and/or shoot bolts (not shown) are extended by an upward rotational input from a door handle 424 (common in the field) that is keyed to central spindle 425 (common in the field). Spindle 425 protrudes and is keyed to crank 427 in central cassette 404. Crank 427 includes upper arm 428 that rotates downwardly to contact captured pin 429 of upper operation bar 410 and to push upper operation bar 410 in a downward direction.

Figure 45:
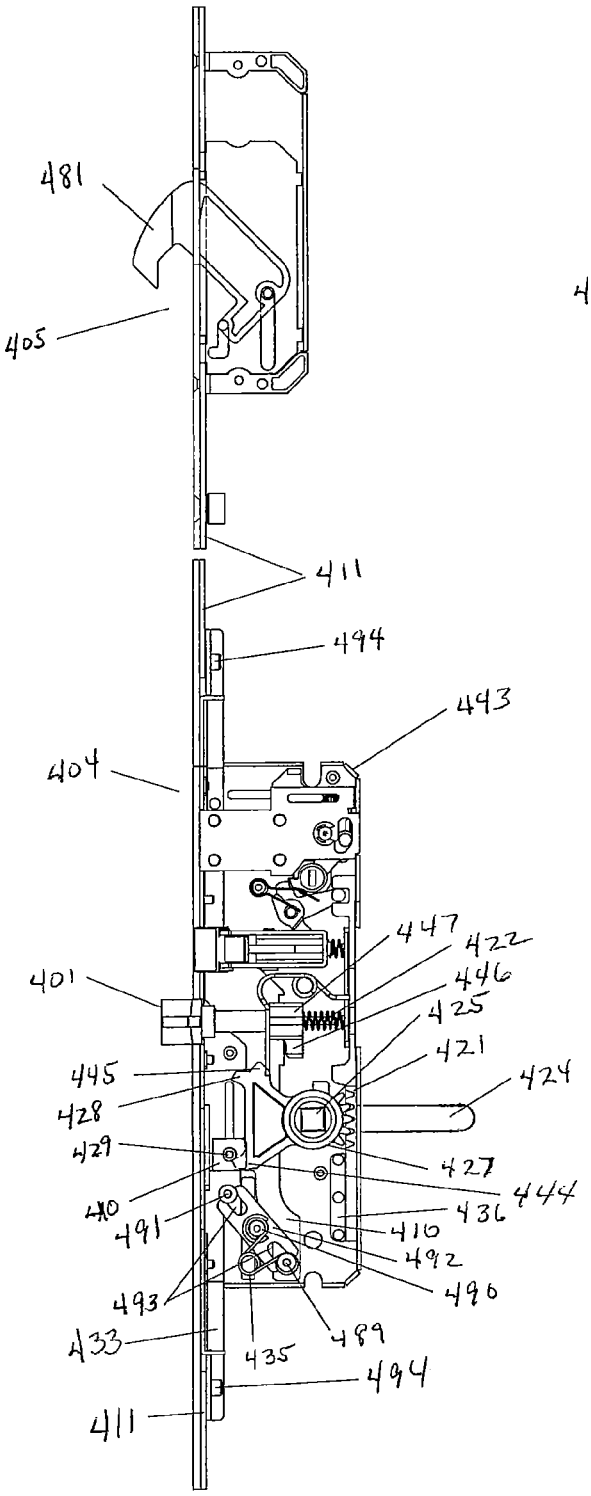
FIG. 45 is a fragmentary side elevation view of the lock assembly of FIG. 37 in a third operational disposition.
Figure 46:
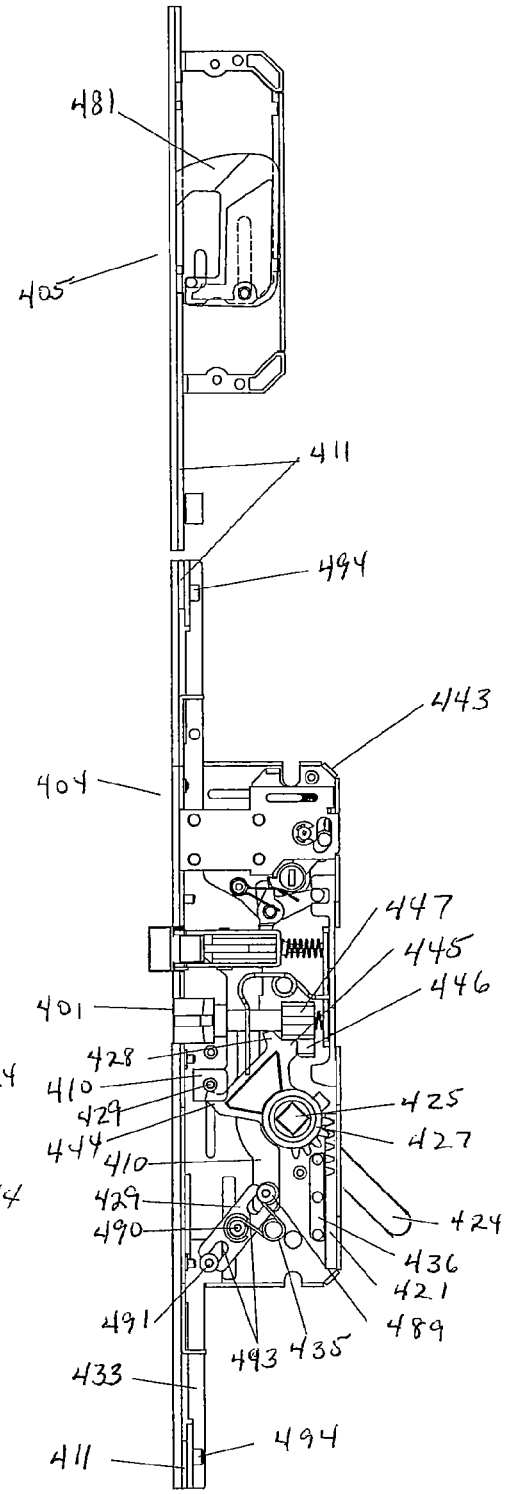
FIG. 46 is a fragmentary side elevation view of the lock assembly of FIG. 37 in a fourth operational disposition.
Figure 49:
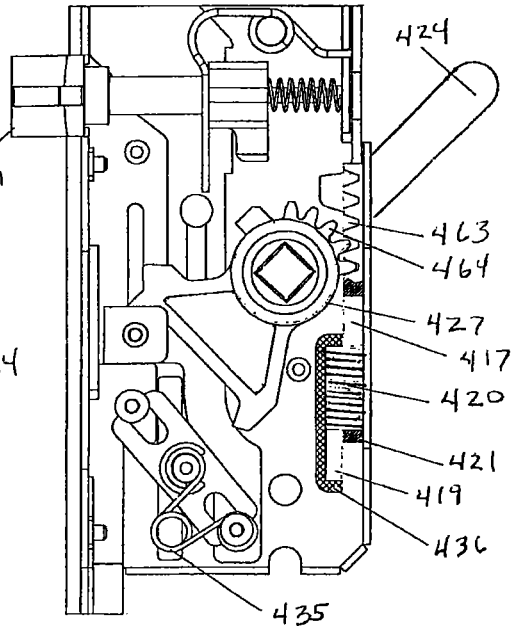
FIG. 49 is a vertical sectional view of the central cassette of the lock assembly of FIG. 37 with the handle in a upward position.

Referring to FIGS. 45 and 46, operation bars 410 and 433 are connected to tie bars 411 by tie bar pins 494. Tie bars 411 are connected to and drive remote locking points 405 to the extended position into strikes located on the door vertical frame and/or, in the case of shoot bolts (not shown), drive shoot bolts (not shown) vertically into strikes located on the door frame header or threshold. Simultaneously, as depicted in FIG. 49, gear teeth 464 on crank 427 drive rack 463 in crank return bar 421. Crank return bar 421 defines chamber 417 that longitudinally contains half of compression spring 420. The other half of compression spring 420 is contained in hollow 419 of crank return housing 436. As crank return bar 421 is driven vertically up, the compartment formed by chamber 417 and hollow 419 shrinks in length compressing spring 420. As door handle 424 is released torsion spring 435 holds operation bars 410 and 433 in the extended position. Compression spring 420 resiliently expands the compartment formed by chamber 417 and hollow 419 returning handle 424 to the neutral position. It is notable that remote locking points 405 and/or shoot bolts (not shown) can be extended in this way regardless of whether the dead bolt 402 is extended or retracted.

Figure 48:
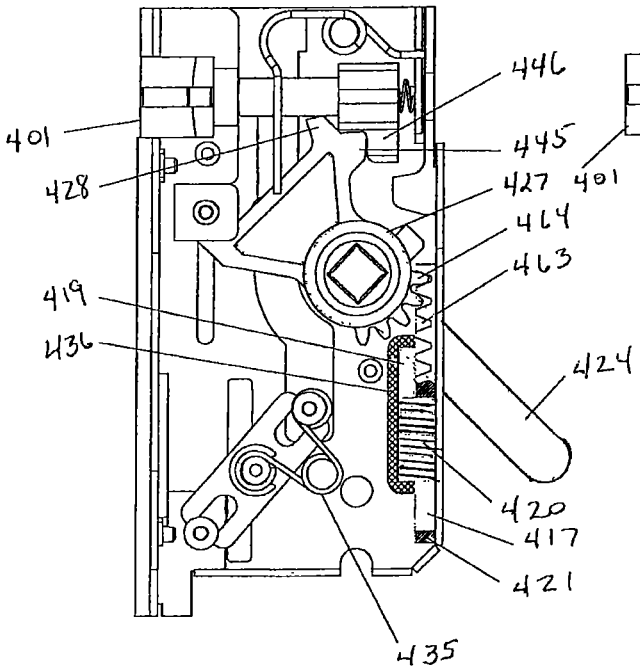
FIG. 48 is a vertical sectional view of the central cassette of the lock assembly of FIG. 37 with the handle in a downward position.

Referring again to FIGS. 45 and 46, remote locking points 405 and/or shoot bolts (not shown) are retracted by a downward rotational input from door handle 424 keyed to central spindle 425 which protrudes through and is keyed to crank 427 in central cassette 404. Crank 427 includes lower arm 444 that rotates upwardly and contacts captured pin 429 in upper operation bar 410 and pushes upper operation bar 410 in an upward direction. Pin 489 of upper operation bar 410 then drives lever 492 rotationally which drives pin 491 in the lower operation bar 433 in a downward direction. Operation bars 410 and 433 drive tie bars 411 via tie bar pin 494. Tie bars 411 drive remote locking points 405 and/or shoot bolts (not shown) to the retracted position disengaging remote locking points 405 and/or shoot bolts (not shown) from strikes in the door frame. Simultaneously, crank 427 has lobe 445 on upper arm 428 that contacts corresponding lobe 446 on latch bolt base 447 which retracts latch bolt 401 that is preloaded by compression spring 422, disengaging latch bolt 401 from strikes in the door frame (not shown). Also simultaneously, as depicted in FIG. 48, gear teeth 464 on crank 427 drive rack 463 in crank return bar 421 in a vertically downward direction. Compression spring 420 contained in the shrinking compartment formed by chamber 417 and hollow 419 is compressed. Alternatively, with remote locking points 405 and/or shoot bolts (not shown) in the retracted position, door handle 424 can be rotated downwardly and latch bolt 401 retracted and compression spring 420 compressed.

As all bolts 401, 402, and 405 and/or 406 are retracted the door panel may now be rotated to the open position. As anti-slam plunger 403 moves away from the door frame it is released to the extended position. Boss 408, as depicted in FIG. 42, on anti-slam plunger 403 moves into slot 409 on upper operation bar 410 blocking movement of upper operation bar 410 and lower operation bar 433, effectively blocking extension of remote locking points 405 and/or shoot bolts (not shown). Simultaneously, as depicted in FIGS. 40 & 41, slot 415 in anti-slam plunger 403 positions end 412 of blocker link 413 such that other end 414 of blocker link 413 rotates to a position in proximity to lobe 416 of dead bolt driver 418 to prevent dead bolt driver 418 from rotating and driving dead bolt 402.

Figure 47:
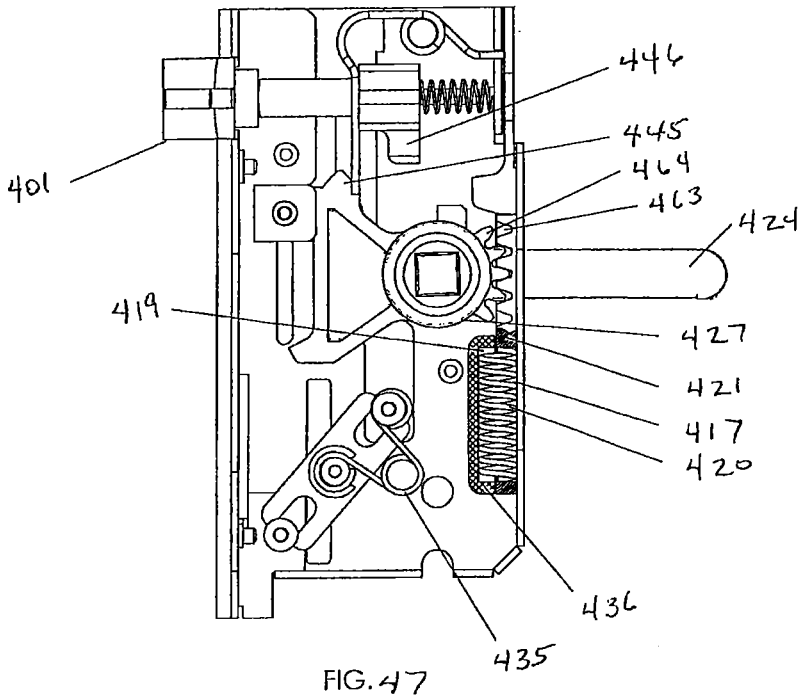
FIG. 47 is a vertical sectional view of the central cassette of the lock assembly of FIG. 37 with the handle in a neutral position.

As shown in FIGS. 47 and 48, when door handle 424 is released torsion spring 435 holds operation bars 410 and 433 in the retracted position while compression spring 420 drives crank return bar 421 which drives handle 424 back to the neutral position through rack 463 and gear teeth 464 on crank 427. Simultaneously, lobe 445 in upper arm 428 of crank 427 rotates away from latch bolt lobe 446 allowing compression spring 422 to extend latch bolt 401.

Figure 50:
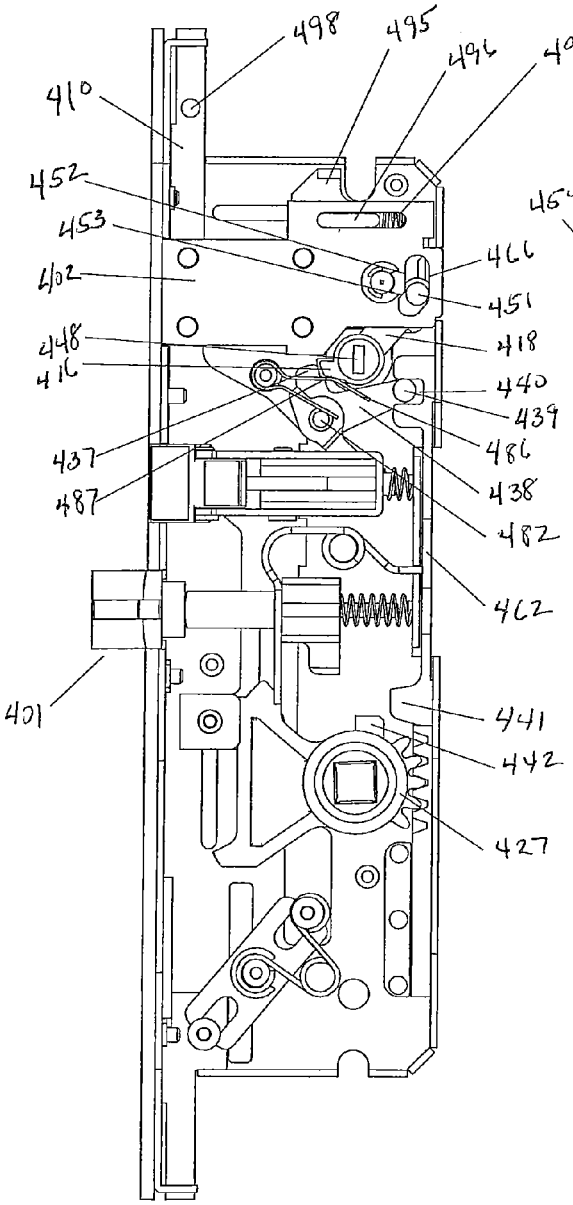
FIG. 50 is a side elevation view of the central cassette of the lock assembly of FIG. 37 with the dead bolt in a retracted position.
Figure 51:
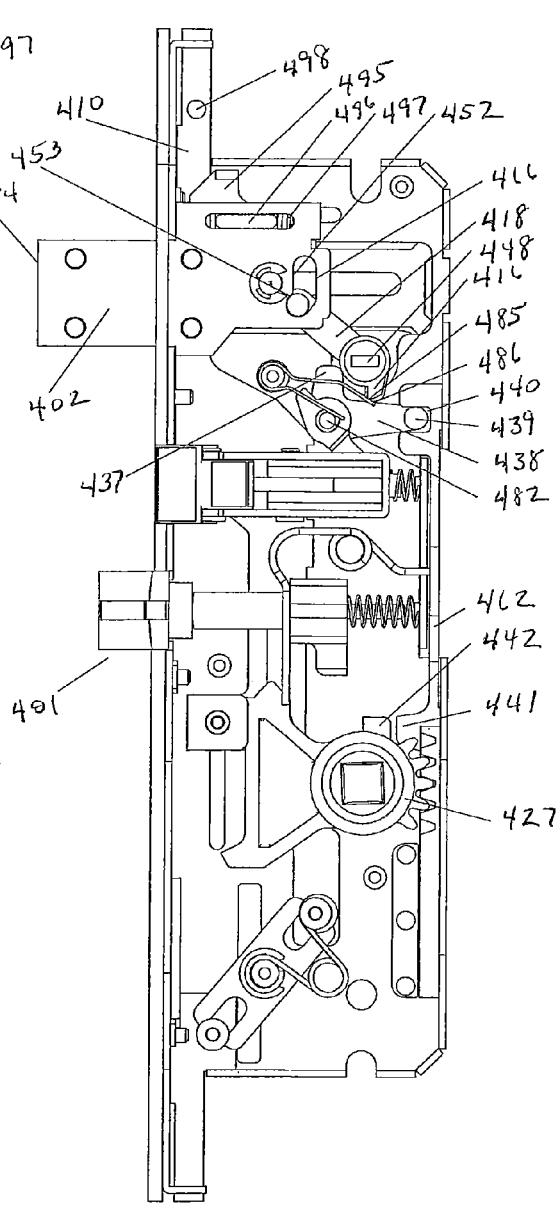
FIG. 51 is a side elevation view of the central cassette of the lock assembly of FIG. 37 with the dead bolt in an extended position.

As in FIGS. 50 and 51, dead bolt 402 is extended by a rotation of a thumb turn or thumb turn/lock cylinder (common in the field, not shown). A spindle (common in the field) protrudes from a thumb turn (not shown) into a slot 448 in dead bolt driver 418. As dead bolt driver 418 rotates, boss 451 on opposite end 455 fits into cam slot 452 driving dead bolt 402 in a horizontal translational motion. Cam slot 452 presents surface 453 such that as dead bolt 402 reaches its maximum extension boss 451 on dead bolt driver 418 reaches a toggle position in cam slot 452 blocking dead bolt 402 from being back driven by a force applied to end surface 454 of the dead bolt 402 parallel to dead bolt 402 translational motion. Simultaneously, lobe 416 of dead bolt driver 418 rotates away from end 437 of link 438 allowing link 438 to rotate about pin 482 and boss 439 on another end of link 438 to rotate downwardly. Slot 440 in stop bar 462 is positioned by boss 439 such that when boss 439 rotates downward, stop bar 462 moves vertically downward such that blocking lobe 441 at the other end of stop bar 462 moves in proximity with tab 442 on crank 427 blocking rotation of crank 427 and handle 424 from retracting latch bolt 401, remote locking points 405, and/or shoot bolts (not shown).

It is important to note that dead bolt 402 can be extended or retracted regardless of whether remote locking points 405 are extended or retracted. Simultaneously, lobe 416 of dead bolt driver 418 has corner 485 that is held in position by spring 486.

Dead bolt 402 is retracted by a rotation of the thumb turn or thumb turn/lock cylinder (common in the field, not shown). A spindle (common in the field) protrudes from the thumb turn into slot 448 in dead bolt driver 418. As dead bolt driver 418 rotates, boss 451 on the end of dead bolt driver 418 then rotates to surface 466 in cam slot 452 of dead bolt 402 that drives dead bolt 402 to the retracted position. Simultaneously, as dead bolt driver 418 rotates to retract dead bolt 402, lobe 416 on dead bolt driver 418 contacts end 437 of link 438 rotating boss 439 upwardly which pushes slot 440 up, lifting crank stop 462 vertically upward. This moves blocking lobe 441 away from tab 442 on crank 427 allowing rotation of the crank 427. Simultaneously, lobe 416 on dead bolt driver 418 has surface 487 that is held in position by spring 486.

It is common in the field to have left hand rotating doors and right hand rotating doors (not shown). Latch bolt 401 and anti-slam plunger 403 in accordance with the invention are able to accommodate the opposing rotations of the doors either by offering separate hardware with opposing ramps, by offering interchangeability, or by making them non-handed.

Figure 52:
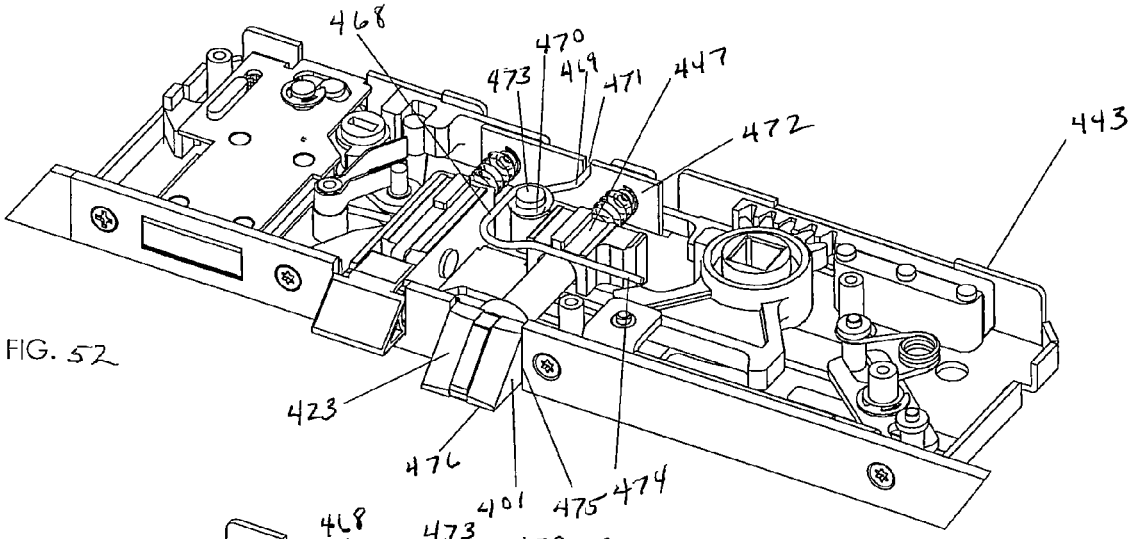
FIG. 52 is a perspective view of the central cassette of the lock assembly of FIG. 37 with the latch bolt in a first rotational position.
Figure 53:
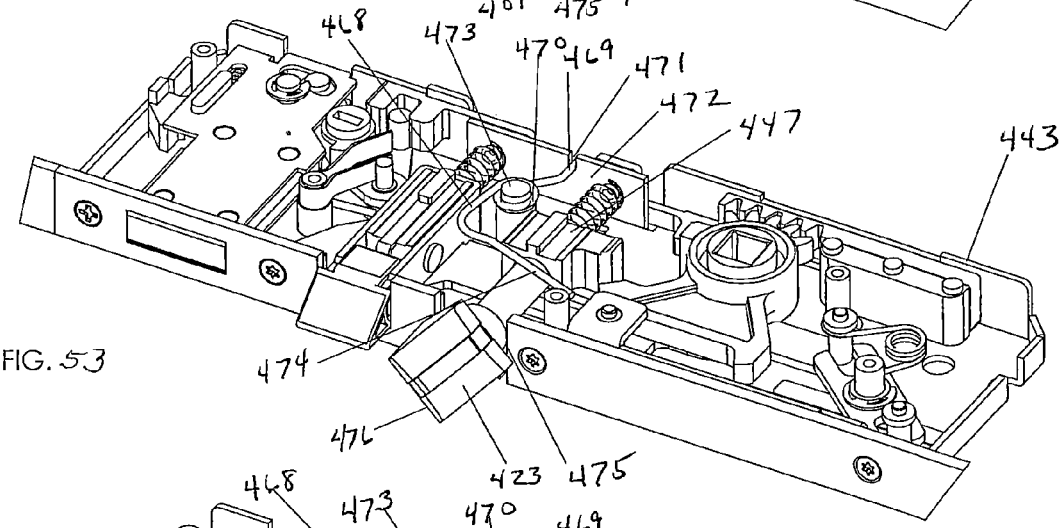
FIG. 53 is a perspective view of the central cassette of the lock assembly of FIG. 37 with the latch bolt in a second rotational position.
Figure 54:
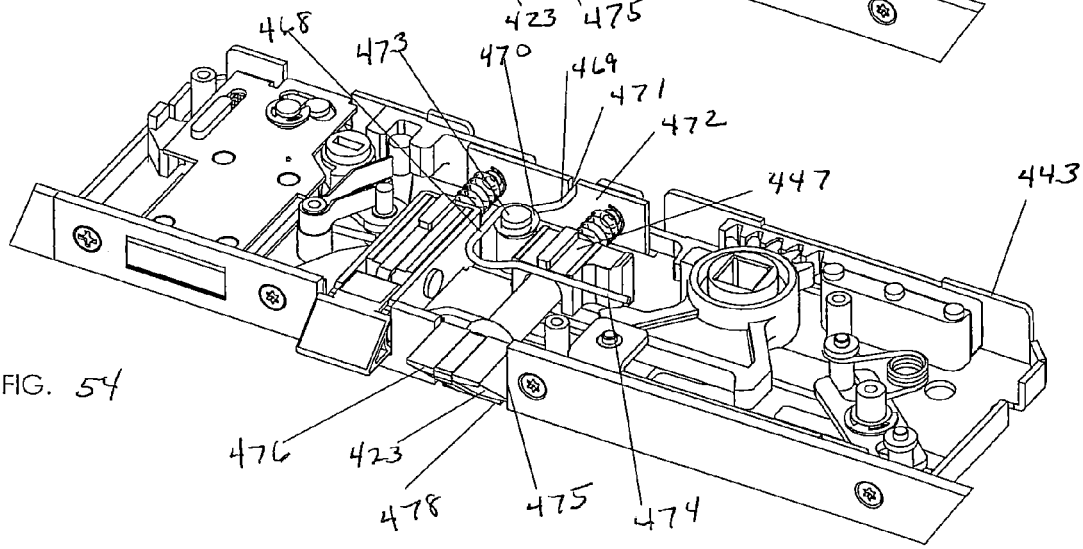
FIG. 54 is a perspective view of the central cassette of the lock assembly of FIG. 37 with the latch bolt in a third rotational position.

As depicted in FIGS. 52, 53 and 54, latch bolt 401, in one embodiment of the invention is made interchangeable by restricting the translational movement of the latch bolt 401 with torsion spring 468. Torsion spring 468 has leg 469 extending from central coil 470 that inserts into notch 471 in bent up wall 472 in cassette housing 443. Central coil 470 raps around standoff 473 secured to housing 443 and in the free unloaded position additional leg 474 extends perpendicular to the direction of travel of latch bolt 401. Additional leg 474 of torsion spring 468 constrains latch bolt 401 at the extended position so as not to extend beyond opening 475 in cassette housing 443. Torsion spring 468 applies a resistance force to latch bolt base 447 as latch bolt end 476 is pulled from and clears housing opening 475. Latch bolt end 476 is then rotated one hundred eighty degrees positioning the ramp 423 on the latch bolt end 476 for the opposite handed door. The torsion spring 468 is allowed to return to its at rest position pulling the latch bolt end 476 back into the housing opening 475. Housing wall 478 and cover wall 479 hold the latch bolt end 476 in rotational position.

As depicted in FIG. 55, anti-slam plunger 403 according to an embodiment of the invention includes a rotating paddle 441 that rotates about a pin 484. This configuration makes anti-slam plunger 403 reversibly handed. As depicted in the upper section, surface 483 of paddle 441 acts as a ramp for a left hand door. Detent 442 bears against end 467 holding paddle 441 in place. As depicted in the lower section, paddle 441 has rotated such that end 467 is held by détente 442 so that surface 488 now acts as the ramp surface for a right hand door, effectively making the anti-slam plunger 403 non-handed.

Figure 56:
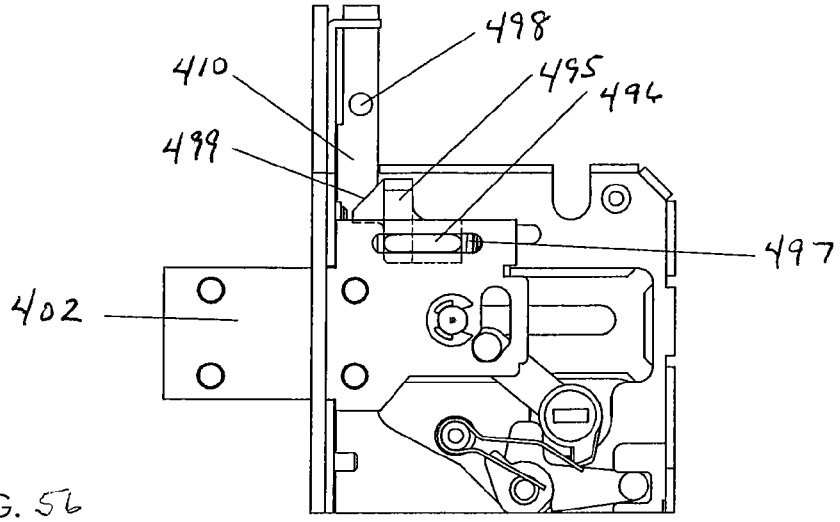
FIG. 56 is a partial side elevation view of the central cassette of the lock assembly of FIG. 37 with the dead bolt in an extended position and an anti-backdrive bolt and locking pin in a first operational position.
Figure 57:
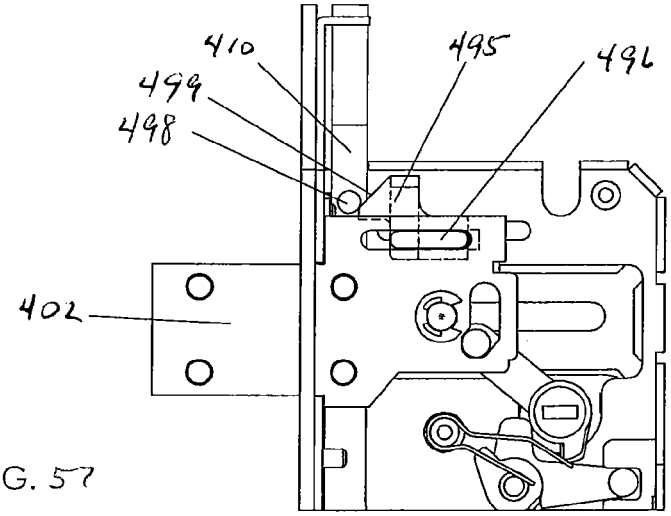
FIG. 57 is a partial side elevation view of the central cassette of the lock assembly of FIG. 37 with the dead bolt in an extended position and an anti-backdrive bolt and locking pin in a second operational position.
Figure 58:
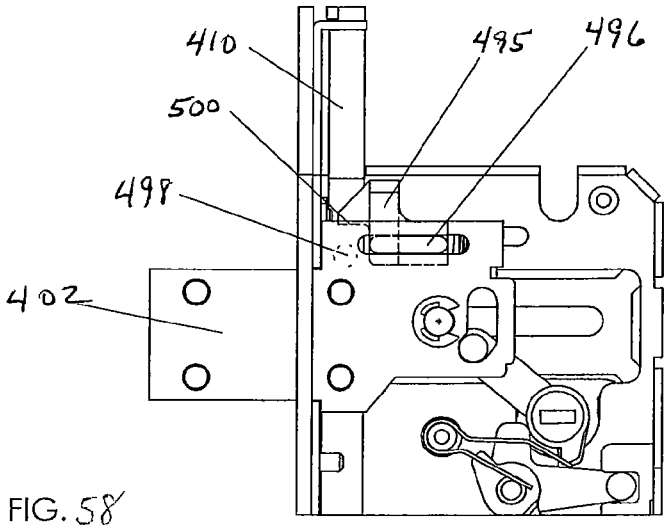
FIG. 58 is a partial side elevation view of the central cassette of the lock assembly of FIG. 37 with the dead bolt in an extended position and an anti-backdrive bolt and locking pin in a third operational position.
Figure 59:
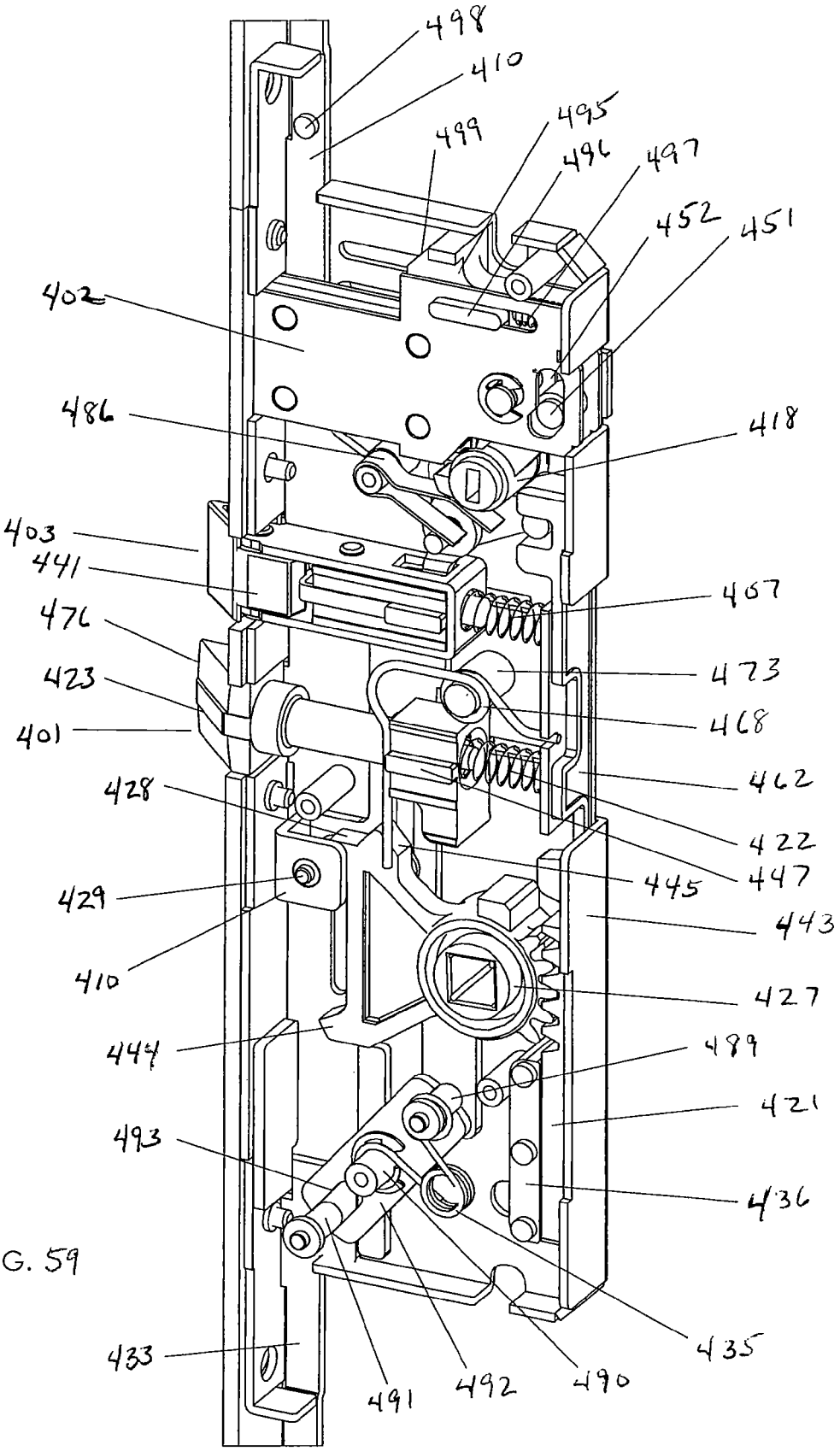
FIG. 59 is a perspective view of the central cassette of the lock assembly of FIG. 37.

As depicted in FIGS. 56, 57 and 58 another embodiment of the invention includes additional anti-backdrive protections. Anti-backdrive bolt 495 is present to prevent back drive of remote locking points 405 and 406 when locking points 405 and 406 are in the extended position. Operation bar 410, which drives the locking points 405 and 406, presents locking pin 498. As depicted in FIG. 56, when dead bolt 402 is in the extended position, anti-backdrive bolt 495 is guided into position by tab 496 and slot 497 held in position by compression spring 500 within slot 497. As shown in FIG. 57, as remote locking points 405 and 406 are extended into position locking pin 498 contacts ramp 499 on anti-backdrive bolt 495 pushing anti-backdrive bolt 495 in a direction compressing compression spring 500 and allowing locking pin 498 to slide by anti-backdrive bolt 495. Referring to FIG. 58, once locking pin 498 is past anti-backdrive bolt 495, undercut surface 502 of anti-backdrive bolt 495 prevents remote locking points 405 and 406 from backdriving to the retracted position.

Figure 60:
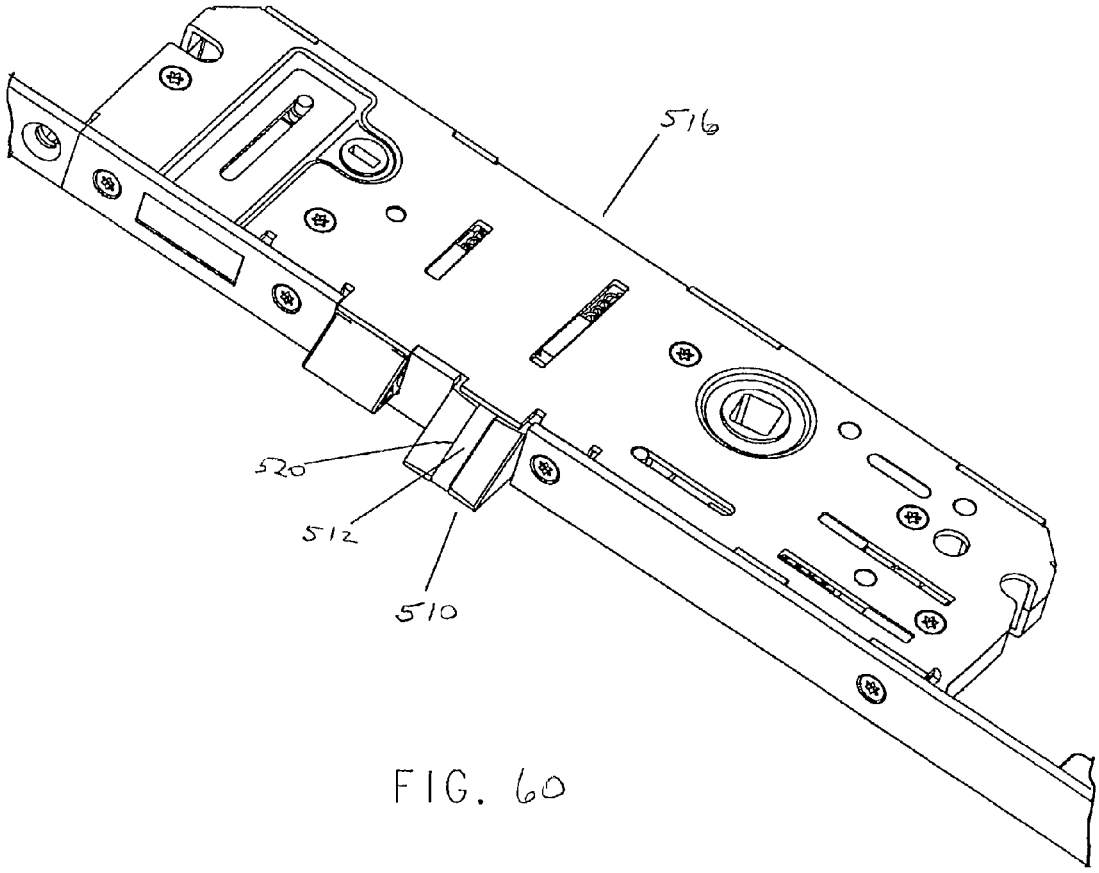
FIG. 60 is a perspective view of a latch cassette with latchbolt according to an embodiment of the invention.
Figure 61:
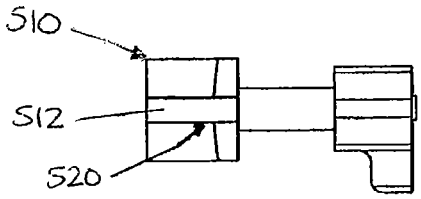
FIG. 61 is a top plan view of a latchbolt according to an embodiment of the invention.

As depicted in FIGS. 60-65, in another embodiment of the invention latchbolt 510 includes integrated latch lubrication strip 512. Referring to FIG. 60, wedge shaped latchbolt 510 is operably disposed in cassette 516, which contains a latch actuating mechanism as described in embodiments above. Latchbolt 510 contacts a strike plate in a door frame (not shown) in such a way as to press spring loaded latchbolt 510 into cassette 516 until latchbolt 510 reaches an opening in the strikeplate, enabling spring loaded latchbolt 510 to engage in the strikeplate opening and secure the door panel to the door frame.

Embodiments of the invention inhibit the scratching and marring of the strike plate and reduce the friction, roughness, and noise of operation of closing.

Figure 64:
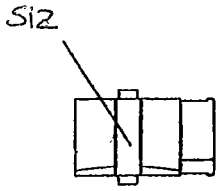
FIG. 64 is a left elevation of the latchbolt of FIG. 61*a*.
Figure 62:
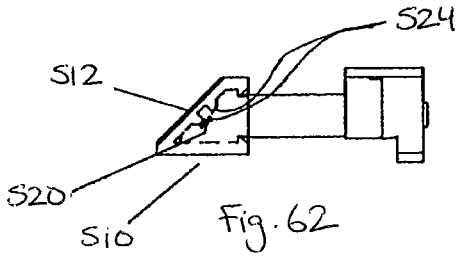
FIG. 62 is a front view of the latchbolt of FIG. 61*a;*
Figure 63:
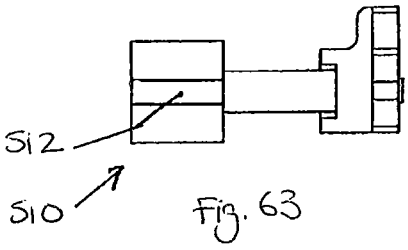
FIG. 63 is a bottom plan view of the latchbolt of FIG. 61*a;*
Figure 65:
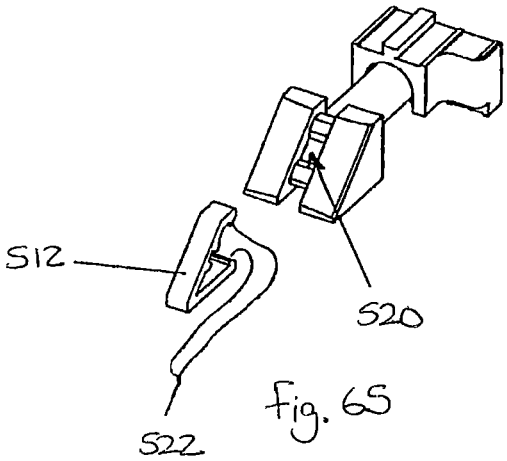
FIG. 65 is a perspective view of a latchbolt according to an embodiment of the invention.

Lubrication strip 512 is fitted into slot 520 defined in latchbolt 510. Lubrication strip 512, in this example surrounds four of five generally planar surfaces of latchbolt 510 that may contact a strike plate (not shown). Referring to FIGS. 62 and 65, lubrication strip 512 presents retaining ridges 522 and alignment ridges 524. Latchbolt 510 presents complementary indentations 526, 528 into which retaining ridges 522 and alignment ridges 524 may be received to secure lubrication strip 512 to latchbolt 510. Accordingly, lubrication strip, as seen in FIGS. 60, 62 and 64 extends outwardly from latchbolt 510 slightly adjacent the four surfaces of latchbolt 510 that may contact a strikeplate thus preventing metal to metal contact between latchbolt 510 and the strike (not shown).

Lubrication strip 512 can be formed from a material that will not scratch or mar the strike plate and has a low coefficient of friction. In a preferred embodiment, lubrication strip 512 may be made from polyacetal or polyoxymethylene polymers. It will be appreciated, however, that any other material with a sufficiently low coefficient of friction and suitable durability qualities may be used, such as for example, high-density polyethylene. Slot 520 may be made of a small enough dimension that the structural integrity of latchbolt 10 is not compromised and it retains sufficient strength to resist forced entry and cyclical wear.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, according to the spirit of the invention. Likewise, the various features described above should all be regarded as example embodiments, rather than limitations to the scope or spirit of the invention. Therefore, the above is not contemplated to limit the scope of the present invention.

For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. A multipoint mortise lock mechanism for a swinging door, comprising:

a central cassette assembly operably coupled to an upper remote locking point assembly and a lower remote locking point assembly by a remote locking linkage;

the central cassette assembly including a housing, a deadbolt mechanism, a latchbolt mechanism, a remote locking point mechanism and an anti-slam mechanism;

the anti-slam mechanism including an anti-slam plunger that when in an extended position engages the remote locking linkage via a boss and a slot and thereby inhibits movement of the remote locking linkage whereby deployment of the remote locking point assemblies is prevented, and wherein the anti-slam plunger comprises a rotatable paddle and a detent, the rotating paddle being shiftable between a first position in which the paddle presents a first sloped surface in a first direction and a second position in which the paddle presents a second sloped surface in a second opposing direction, the detent holding the paddle in either of the first position or the second position; and the deadbolt mechanism including a deadbolt extendible from the central cassette and being independently operable from the remote locking point mechanism, the deadbolt mechanism further comprising an anti-back drive mechanism.

2. The multipoint mortise lock mechanism as claimed in claim 1, wherein the remote locking linkage further comprises a slidable member coupled to the upper remote locking point assembly or the lower remote locking point assembly and a torsion spring coupled to the slidable member and arranged to hold the slidable member in an upper position or a lower position.

3. The multipoint mortise lock mechanism as claimed in claim 1, wherein the latchbolt mechanism further comprises a latchbolt and wherein the latchbolt can be changed from a first handedness to a second opposed handedness.

4. The multipoint mortise lock mechanism as claimed in claim 3, wherein the latchbolt further comprises a lubrication strip that protrudes relative to all surfaces of the latch bolt that are configured to make contact with a strike.

5. The multipoint mortise lock mechanism as claimed in claim 4, wherein the lubrication strip protrudes relative to four generally planar surfaces of the latchbolt that are configured to make contact with a strike.

6. The multipoint mortise lock mechanism as claimed in claim 1, wherein the remote locking linkage comprises an upper drive bar and a lower drive bar.

7. The multipoint mortise lock mechanism as claimed in claim 6, wherein the upper drive bar and the lower drive bar are operably coupled to operate in opposite directions by a drive bar linkage.

8. The multipoint mortise lock mechanism as claimed in claim 7, wherein the drive bar linkage comprises a first rack coupled to the upper drive bar and a second rack coupled to the lower drive bar, the first rack being operably coupled to the second rack by a pinion.

9. The multipoint mortise lock mechanism as claimed in claim 7, wherein the drive bar linkage comprises a pivotable lever linked at a first end thereof to the upper drive bar and linked at a second end thereof to the lower drive bar.

10. A multipoint mortise lock mechanism for a swinging door, comprising:

a central cassette assembly operably coupled to an upper remote locking point assembly and a lower remote locking point assembly by a remote locking linkage;

the central cassette assembly including a housing, a deadbolt mechanism, a latchbolt mechanism, a remote locking point mechanism, an anti-slam mechanism, and a handle mechanism operably coupled to the latchbolt mechanism and the remote locking point mechanism, the handle mechanism including a rotatable handle;

the anti-slam mechanism including an anti-slam plunger that when in an extended position engages the remote locking linkage via a boss and a slot and thereby inhibits movement of the remote locking linkage whereby deployment of the remote locking point assemblies is prevented;

the deadbolt mechanism including a deadbolt extendible from the central cassette and being independently operable from the remote locking point mechanism, the deadbolt mechanism further comprising an anti-back drive mechanism, wherein the deadbolt mechanism further comprises a deadbolt driver having a first portion coupled to the deadbolt that extends the deadbolt upon shifting from a first position to a second position and a second portion that engages a stop bar and shifts the stop bar to block rotation of the handle when the deadbolt driver is in the second position.

11. The multipoint mortise lock mechanism as claimed in claim 10, wherein the deadbolt driver presents a lobe and comprises a spring biased against the lobe of the deadbolt driver, the spring acting to hold the deadbolt driver in the first position or in the second position.

12. The multipoint mortise lock mechanism as claimed in claim 10, the deadbolt anti-backdrive mechanism further comprising a spring loaded pawl biased to bear against the deadbolt, wherein the deadbolt presents a notch into which the pawl engages when the deadbolt is extended, the pawl inhibiting backdriving of the deadbolt and wherein the deadbolt driver presents a lifter that lifts the pawl from the notch when the deadbolt driver is shifted thus permitting retraction of the deadbolt when desired.

13. The multipoint mortise lock mechanism as claimed in claim 10, further comprising a compression spring, the compression spring being captured in two slidably opposed cavities including a first cavity and a second cavity, the first cavity being defined by a crank return bar and the second cavity being defined by a crank return housing, the compression spring biasing the rotatable handle to a neutral position from either an upwardly rotated position or a downwardly rotated position by biasing interaction with the first cavity and the second cavity.

14. A multipoint mortise lock mechanism for a swinging door, comprising:

a central cassette assembly operably coupled to an upper remote locking point assembly and a lower remote locking point assembly by a remote locking linkage;

the central cassette assembly including a housing, a deadbolt mechanism, a latchbolt mechanism, a remote locking point mechanism and an anti-slam mechanism;

the anti-slam mechanism including an anti-slam plunger that when in an extended position engages the remote locking linkage via a boss and a slot and thereby inhibits movement of the remote locking linkage whereby deployment of the remote locking point assemblies is prevented;

the deadbolt mechanism including a deadbolt extendible from the central cassette and being independently operable from the remote locking point mechanism, the deadbolt mechanism further comprising an anti-back drive mechanism, the deadbolt anti-back drive mechanism further comprising an anti-backdrive bolt, the anti-backdrive bolt being shiftable between an advanced position and a retracted position and being resiliently biased toward the advanced position when in the advanced position, the remote locking linkage including a locking member shiftable past the anti-backdrive bolt as the remote locking linkage is shifted between a remote locking point extended position and a remote locking point retracted position, the locking member being engageable by the anti-backdrive bolt when the anti-backdrive bolt is in the advanced position and being inhibited from moving against a force applied to backdrive the remote locking linkage toward the remote locking point retracted position by engagement with the anti-backdrive bolt whereby backdriving of the remote locking points is prevented.

* * * * *